US010421523B2

(12) United States Patent
Opsahl et al.

(10) Patent No.: US 10,421,523 B2
(45) Date of Patent: Sep. 24, 2019

(54) SPREAD MOORED BUOY AND FLOATING PRODUCTION SYSTEM

(71) Applicant: NOV APL Limited, Zuid-Holland (NL)

(72) Inventors: Hans Emil Opsahl, Oslo (NO); Evert Olaus Grodal, Risor (NO)

(73) Assignee: NOV APL Limited (NL)

( * ) Notice: Subject to any disclaimer, the term of this patent is extended or adjusted under 35 U.S.C. 154(b) by 0 days.

(21) Appl. No.: 15/665,422

(22) Filed: Jul. 31, 2017

(65) Prior Publication Data

US 2019/0031296 A1 Jan. 31, 2019

(51) Int. Cl.

| | |
|---|---|
| ***B63B 22/02*** | (2006.01) |
| ***B63B 35/44*** | (2006.01) |
| ***B63B 35/40*** | (2006.01) |
| ***B63B 22/18*** | (2006.01) |

(52) U.S. Cl.

CPC ..... *B63B 22/021* (2013.01); *B63B 22/18* (2013.01); *B63B 35/40* (2013.01); *B63B 35/44* (2013.01); *B63B 2035/448* (2013.01)

(58) Field of Classification Search

CPC ..... B63B 21/00; B63B 21/50; B63B 22/02; B63B 21/06; B63B 21/10; B63B 21/20; B63B 21/24; B63B 21/26; B63B 21/27; B63B 35/44; B63B 22/04

USPC ..... 114/293; 441/3, 4, 5

See application file for complete search history.

(56) References Cited

U.S. PATENT DOCUMENTS

| | | | | |
|---|---|---|---|---|
| 4,892,495 | A | 1/1990 | Svensen | |
| 5,305,703 | A * | 4/1994 | Korsgaard | B63B 22/023 441/4 |
| 5,339,760 | A * | 8/1994 | Korsgaard | B63B 22/026 441/3 |
| 5,380,229 | A * | 1/1995 | Korsgaard | B63B 22/023 441/3 |
| 5,515,803 | A * | 5/1996 | Korsgaard | B63B 22/023 441/4 |
| 6,595,154 | B2 | 7/2003 | Boatman | |
| 7,510,452 | B2 | 3/2009 | Van Tol et al. | |
| 7,681,511 | B2 | 3/2010 | Breivik et al. | |
| 7,770,532 | B2 | 8/2010 | Bauduin et al. | |
| 8,418,639 | B2 | 4/2013 | Hooper et al. | |
| 8,651,040 | B2 | 2/2014 | Heideman et al. | |
| 9,227,701 | B2 | 1/2016 | Woldring et al. | |
| 2011/0263169 | A1* | 10/2011 | Meling | B63B 21/50 441/4 |
| 2014/0345512 | A1* | 11/2014 | Meling | B63B 21/50 114/293 |
| 2015/0031252 | A1 | 1/2015 | Li et al. | |

(Continued)

FOREIGN PATENT DOCUMENTS

| | | |
|---|---|---|
| WO | 2011047736 | 4/2011 |
| WO | 2012032163 | 3/2012 |

*Primary Examiner* — Lars A Olson

(74) *Attorney, Agent, or Firm* — Conley Rose, P.C.

(57) ABSTRACT

An offshore production and storage system includes a spread moored buoy assembly including a riser buoy coupled to a mooring buoy, the riser buoy configured to receive and couple to risers, wherein the spread moored buoy assembly is configured to be pre-installed offshore with the risers coupled thereto, and wherein the spread moored buoy assembly is configured to couple to a floating vessel such that the risers fluidicly couple to the floating vessel via the riser buoy.

16 Claims, 23 Drawing Sheets

(56) References Cited

U.S. PATENT DOCUMENTS

| | | | |
|---|---|---|---|
| 2015/0101522 | A1 | 4/2015 | Younan et al. |
| 2015/0284054 | A1 | 10/2015 | Kokkinis et al. |

* cited by examiner

SPREAD MOORED BUOY AND FLOATING PRODUCTION SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Offshore hydrocarbon drilling and production systems require a fluid connection between the subsea production system and the floating production storage and offloading vessel (FPSO). Upon arrival at the offshore wellsite, the FPSO can be secured to the seabed or dynamically positioned using an onboard propulsion system. A mooring system is used to couple the FPSO to the seabed. A spread mooring of the FPSO can ensure position control and a fixed heading of the FPSO at the sea surface. Various mechanisms and apparatus are used to connect the subsea production or manifold system to the FPSO for transferring hydrocarbons. A spread mooring connection will physically connect to the FPSO. A riser connection or hook-up will fluidicly connect the subsea production system to the FPSO. For example, the fluid connection between the subsea system and the FPSO can be used for hydrocarbon production, water injection, gas injection, chemical injection, control lines, and the like.

Typically, risers and spread mooring are located at the outside of the hull of the FPSO, such as at the port and/or starboard side, and are installed after the FPSO has arrived at the operation wellsite. The spread mooring system is typically installed in four mooring clusters from four locations on the vessel. The mooring lines can be made from chains and neutrally buoyant polyester rope. Pile or suction anchors can be used to fix the mooring and is typically preinstalled before FPSO arrival. The connection of the mooring lines is done after FPSO arrival at the wellsite with the help of construction vessels and positioning tug boats. After the mooring lines are handed over to the FPSO they are pre-tensioned using an onboard mooring tension system.

A riser balcony at a side of the FPSO is configured to receive and connect to the risers. The risers may be free hanging. The riser balcony typically includes a lower riser balcony, an upper riser balcony, and a pull-in balcony. The lower riser balcony is used to fix the risers laterally to the vessel through a riser bend restrictor. The upper riser balcony is used to fix the risers vertically. The pull-in balcony often includes a skidding rail or similar structure to allow the pull-in device and/or sheave to travel longitudinally to pull in/out each riser. The risers are pulled in individually with a handover from a flex lay vessel. The commissioning of the wells can start after the risers are pulled in and connected. The pull-in of risers is performed after all mooring lines are installed.

Deep waters with large quantities of risers routed directly to the FPSO result in high loads on the side of the FPSO hull. Normally risers are routed to only one side of the hull to allow safe approach for supply vessels at the opposite side. In order to maintain stability and buoyancy, extra ballast tanks and/or buoyancy may be required. However, extra ballast or void tanks will reduce the available cargo capacity or increase the required steel material needed. Alternative ways to reduce riser loads include using separate buoyancy solutions to support the riser weights, or reducing the quantity of risers through subsea manifolding. However, both of these options are costly and reduce operational flexibility. In addition to the reduction of cargo capacity in the FPSO, having the risers suspended from the side of the vessel also has a negative impact on the riser fatigue life. The support structures from which the risers hang are away from the vessel center, thereby creating a lever arm on the vessel and amplifying the vessel motions in the risers. The FPSO is subjected to rolling motion from the sea water, and wave slamming motion at the FPSO hull side where the risers are suspended. These two factors, vessel motion and wave slamming, introduce high load on the risers thereby decreasing riser fatigue life.

BRIEF DESCRIPTION OF THE DRAWINGS

The subject disclosure is further described in the following detailed description, and the accompanying drawings and schematics of non-limiting embodiments of the subject disclosure. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
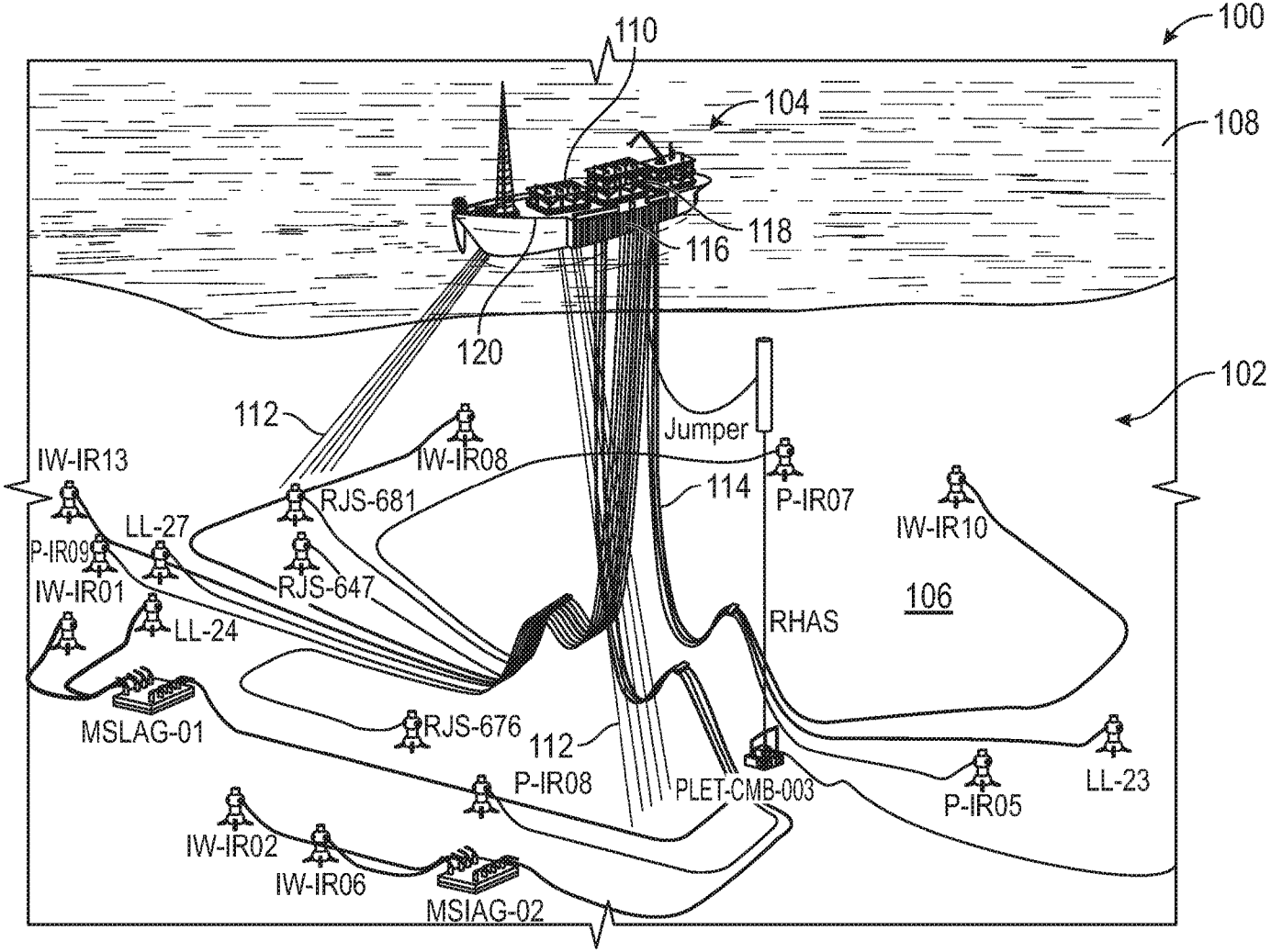
FIG. 1 is a perspective view of an offshore production and storage system including a spread moored FPSO with a fixed heading.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Figure 2:
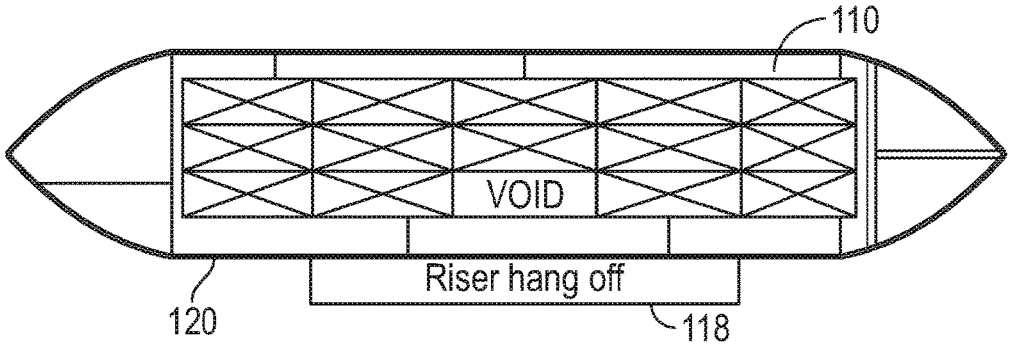
FIG. 2 is a top schematic view of the FPSO of FIG. 1, showing an external or side riser balcony for riser hang-off.

Referring to FIG. 1, an offshore production and storage system 100 for producing a subsea well or wells is shown. A subsea production system 102 directs produced fluids, such as subterranean hydrocarbons, from seabed 106 to a series of conduits or risers 114. In other embodiments, the risers 114 can be used for gas injection, water injection, chemical injection, or service lines. In addition to the risers 114, umbilical control lines are commonly needed for control and monitoring of the subsea tree, valves, and flowlines. The risers 114 extend toward sea surface 108 and a storage system 104. The storage system 104 includes a floating vessel or FPSO 110 with a fixed heading. The risers 114 couple to connections 116 in the FPSO 110. The connections 116 are supported by a riser balcony 118 at a side or external portion 120 of the FPSO 110. The riser balcony 118 is the riser hang-off location on the FPSO 110 for the risers 114. The FPSO 110 can be position moored with a fixed heading by a series of mooring clusters 112. As shown in FIG. 2, the riser balcony 118 is located on a side of the FPSO 110 for an external hang-off location for the risers 114.

Figure 3:
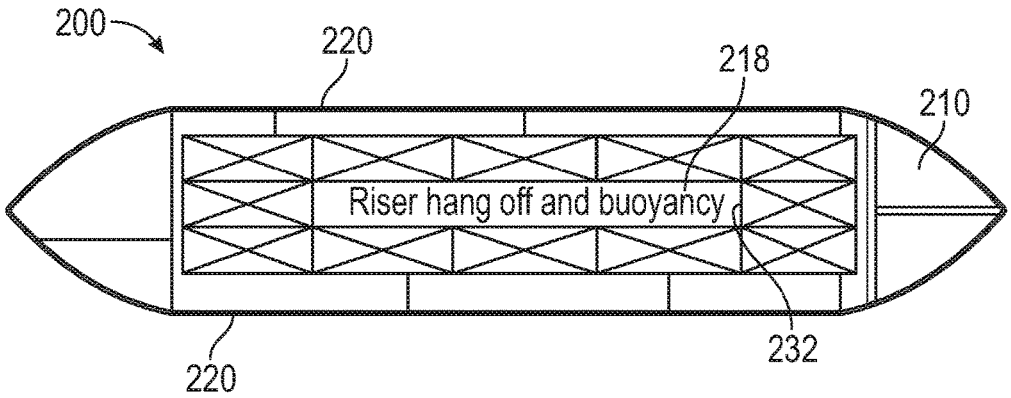
FIG. 3 is a top schematic view of an embodiment of a FPSO including a central or internal riser buoyancy and hang-off system in accordance with principles disclosed herein.
Figure 4:
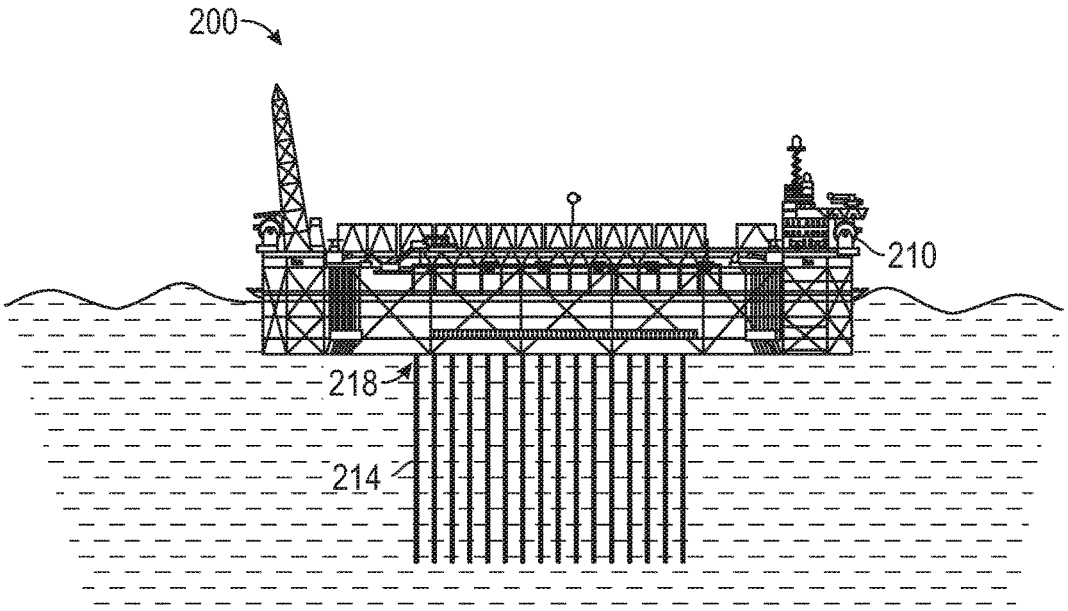
FIG. 4 is a side schematic view of the FPSO of FIG. 3 with hanging risers.
Figure 5:
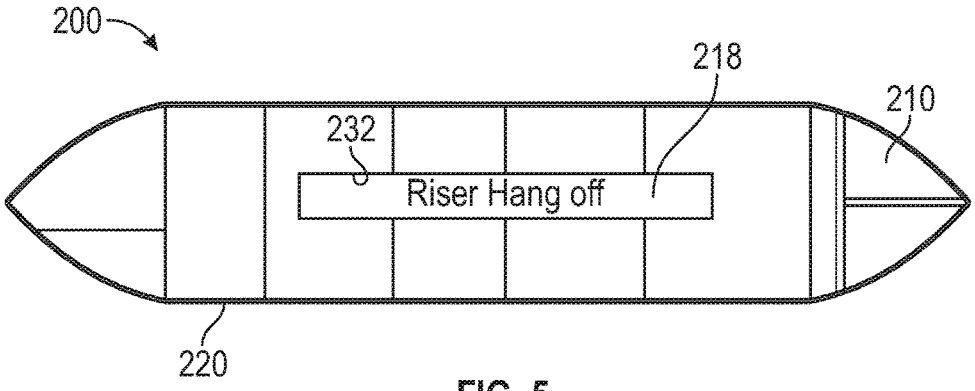
FIG. 5 is a bottom schematic view of the FPSO of FIGS. 3 and 4 showing the central or internal riser hang-off location.

Referring next to FIG. 3, a top view of an embodiment of a storage system 200 is shown in accordance with certain principles disclosed herein. An FPSO 210 includes a riser buoyancy and connection, or hang-off, system 218 located centrally or internally of sides 220 of the FPSO 210. In some embodiments, the sides 220 include ballast or void tanks. As used herein, central or internal does not indicate a precisely central location of the FPSO 210, but rather a location moved inwardly from an outermost extent 220 of the FPSO 210 at a perimeter of the FPSO. In FIG. 4, the riser buoyancy and hang-off system 218 is a fluidic connection between the FPSO 210 and a series of subsea risers 214. As shown in FIG. 5, the riser hang-off location at the riser buoyancy and hang-off system 218 is located inwardly of the external perimeter 220 of the FPSO 210.

Figure 6:
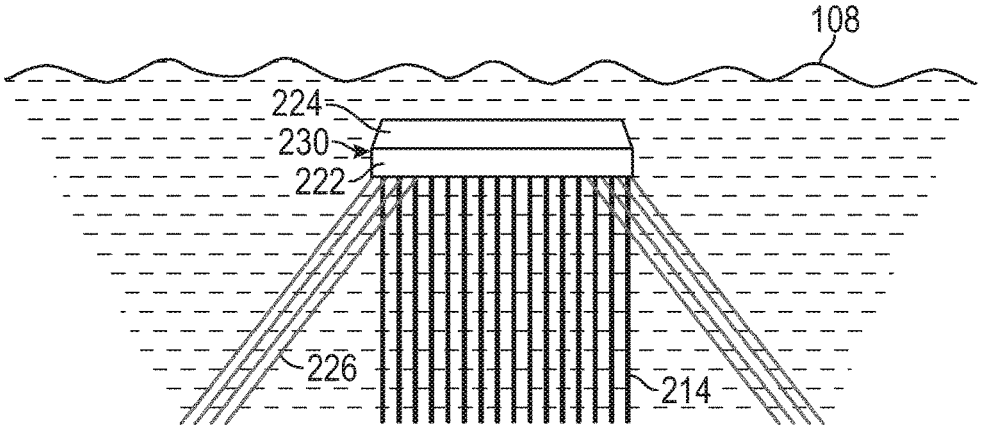
FIG. 6 is a schematic side view of an embodiment of a pre-installed spread moored buoy assembly in accordance with principles disclosed herein.
Figure 7:
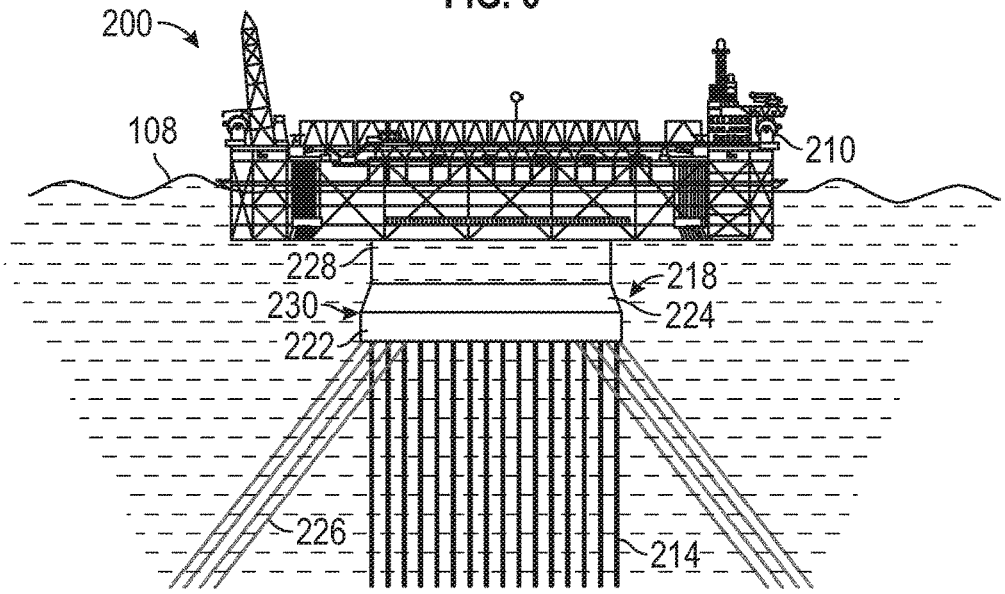
FIG. 7 is a schematic side view of the spread moored buoy assembly of FIG. 6 coupled by ropes to the FPSO.
Figure 8:
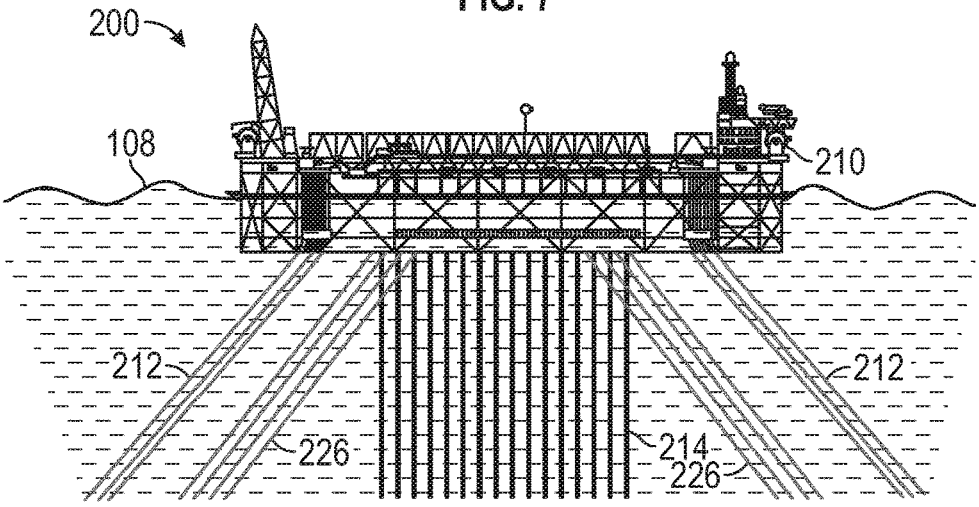
FIG. 8 is a schematic side view of the spread moored buoy assembly of FIGS. 6 and 7 secured in a bay of the FPSO.

Referring now to FIG. 6, the riser buoyancy and hang-off system 218 includes a spread moored buoy (SMB) assembly 230 including a buoy portion 222 and a riser connection or hang-off portion 224, the details of which will be described in greater detail below. The buoy portion 222 may also be referred to as a mooring buoy or a spread moored buoy. Coupled to the buoy portion 222 are mooring lines or clusters 226 and risers 214. In some embodiments, the spread moored buoy assembly 230 can be pre-installed and pre-commissioned at the subsea production system 102 site prior to arrival of the FPSO 210. As shown in FIG. 7, upon arrival of the FPSO 210, the FPSO 210 can be coupled to the spread moored buoy assembly 230 using ropes 228. Referring to FIG. 8, the ropes 228 are used to pull the spread moored buoy assembly 230 into a void, cavity, or bay 232 (as shown in FIGS. 3 and 5) in the FPSO 210 where, as will be described in greater detail below, the spread moored buoy assembly 230 is secured and fluidicly connected for fluid transfer to the FPSO 210. Mooring clusters 226 couple to the spread moored buoy assembly 230 and are used for position mooring of the spread moored buoy assembly 230. In some embodiments, the mooring clusters 226 are used for position mooring the spread moored buoy assembly 230 and the FPSO 210 after the spread moored buoy assembly 230 is secured in the FPSO 210. In some embodiments, additional mooring clusters 212 can be used for further securing the position mooring of the FPSO 210.

Figure 9:
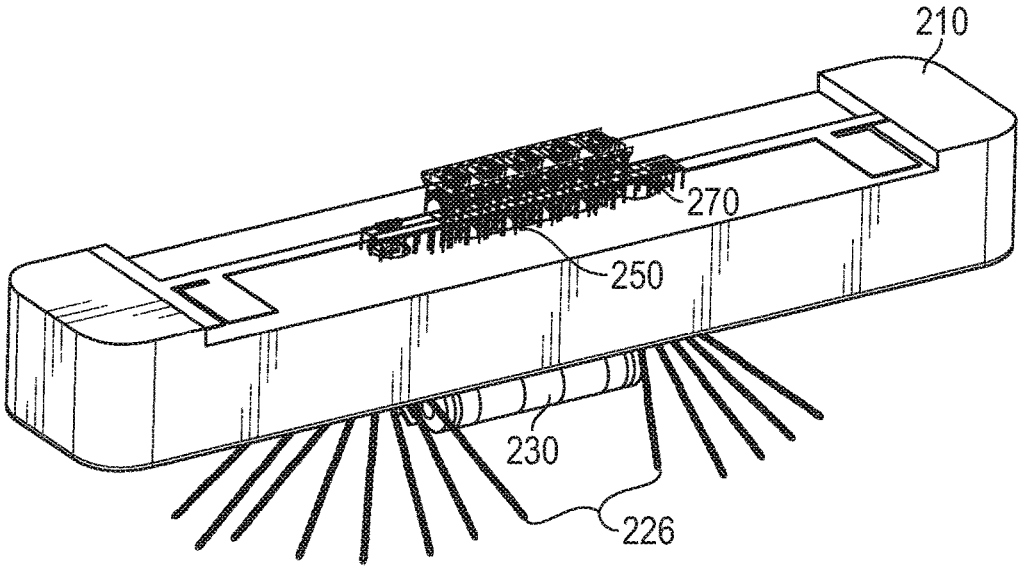
FIG. 9 is a schematic perspective view of the FPSO and spread moored buoy assembly system of FIG. 8.
Figure 10:
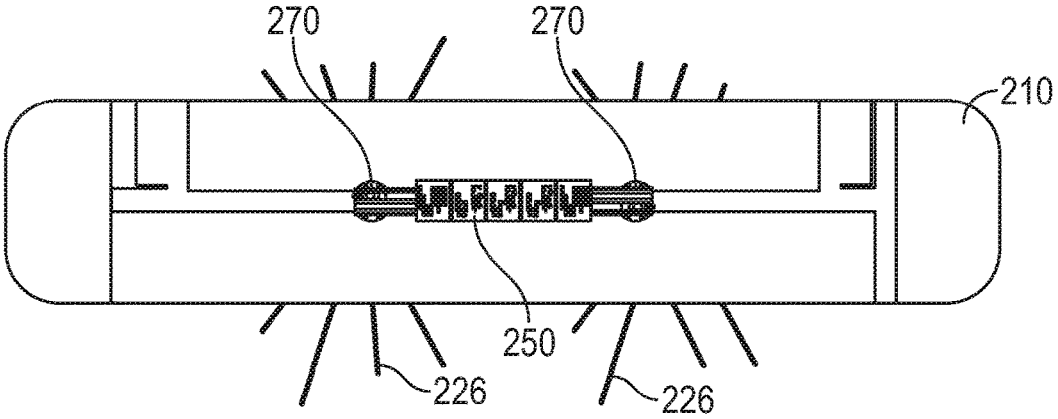
FIG. 10 is a top view of the FPSO and spread moored buoy assembly system of FIG. 9.

Referring next to FIG. 9, a perspective view of the FPSO 210 shows the spread moored buoy assembly 230 secured in the FPSO 210 and by the mooring clusters 226. The FPSO 210 also supports a topside manifold system 250 and a lift or pull-in system 270 of the riser buoyancy and hang-off system 218, both of which will be described in greater detail below. A top view of the FPSO 210 in FIG. 10 shows the topside manifold system 250 positioned adjacent the lift or pull-in system 270 which is disposed above mooring buoys (not shown) of the spread moored buoy assembly 230.

Figure 11:
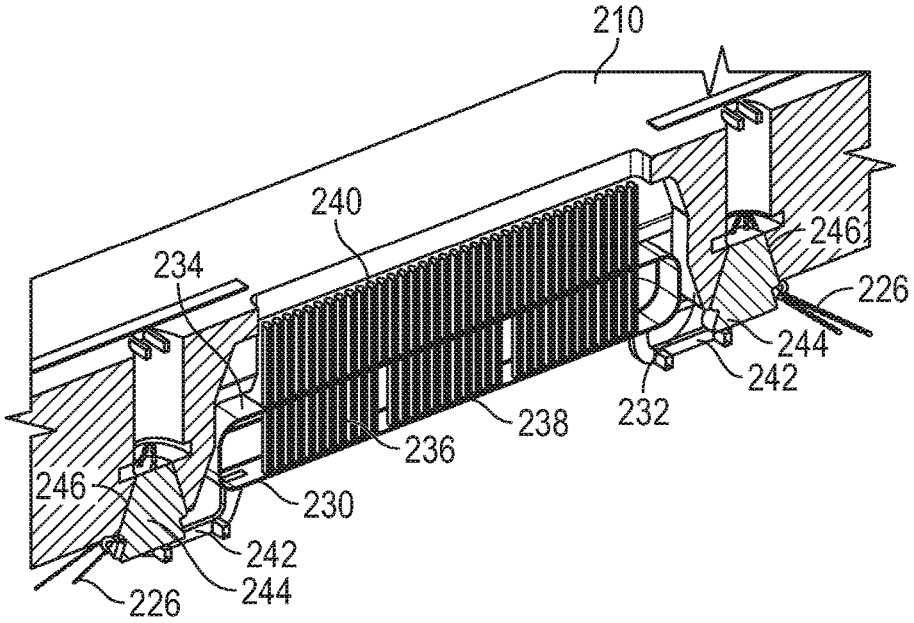
FIG. 11 is a cross-section view of the FPSO and spread moored buoy assembly system of FIG. 9.
Figure 12:
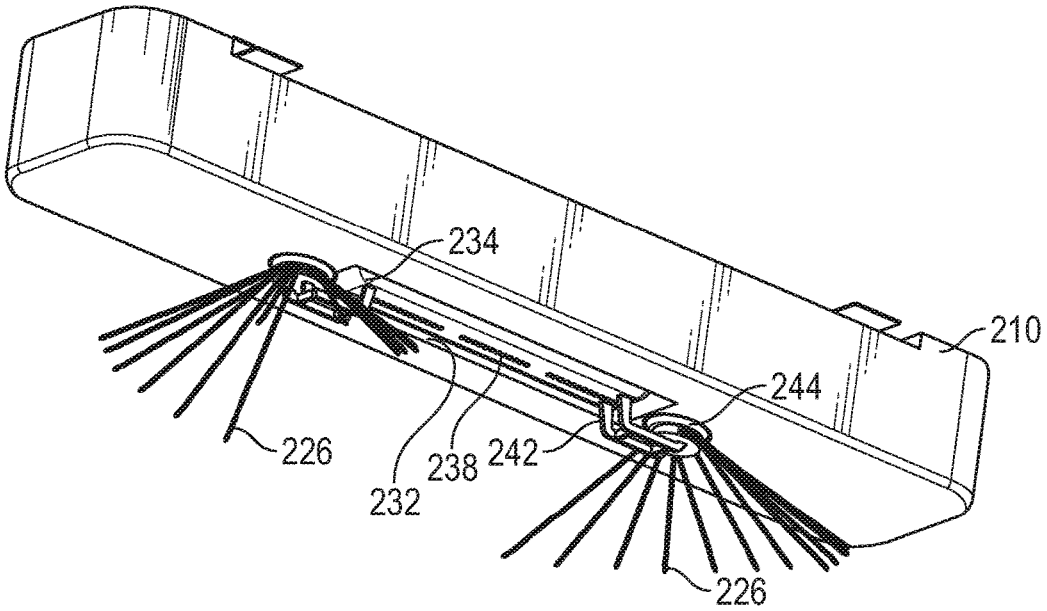
FIG. 12 is a bottom perspective view of the FPSO and spread moored buoy assembly system of FIG. 9.
Figure 13:
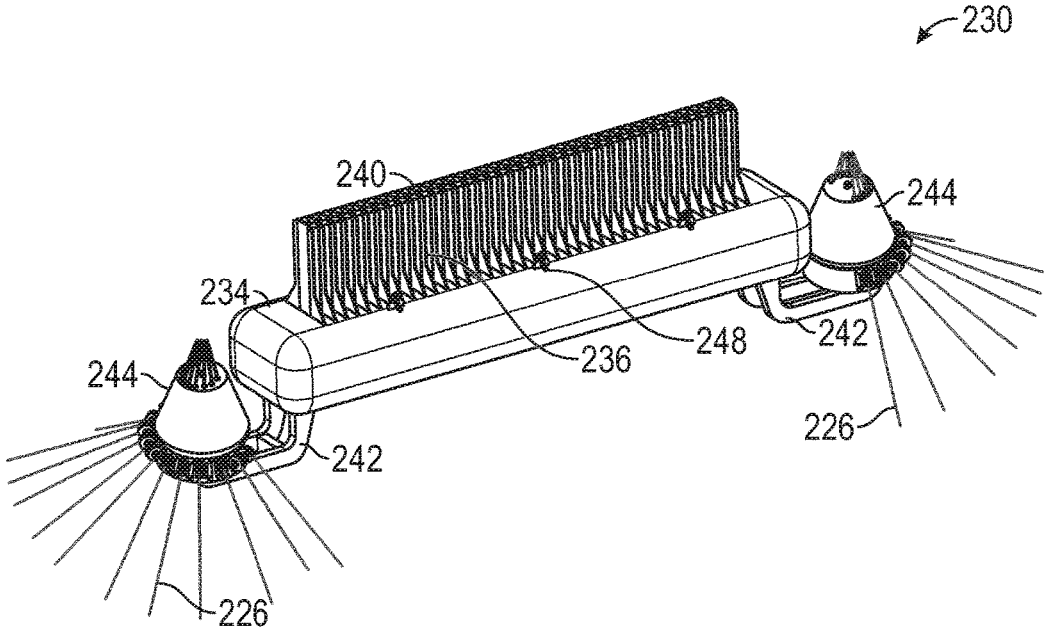
FIGS. 13 and 14 are schematic perspective views of the spread moored buoy assembly of FIG. 9 isolated from the FPSO.
Figure 14:
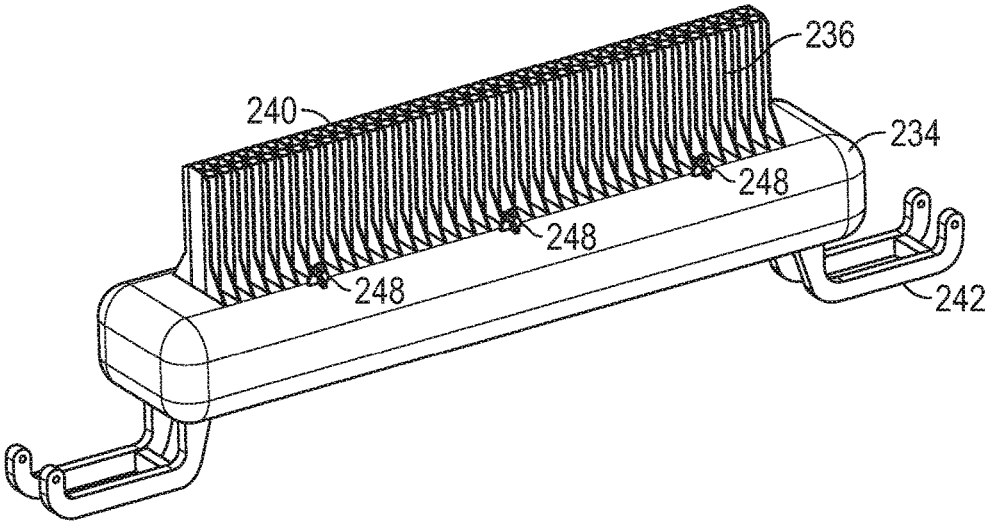

Referring to FIG. 11, a cross-section of FIG. 9 illustrates additional details of the spread moored buoy assembly 230 received and secured in the bay 232. The spread moored buoy assembly 230 includes a riser buoy housing or hull 234, a riser tower 236, riser bend restrictors 238, and riser connectors or hang-off mechanism 240. Compensation arms 242 extend from the riser buoy 234 and support mooring buoys 244. Mooring lines 226 couple to the mooring buoys 244. Mooring buoy hull cavities 246 receive the mooring buoys 244. Referring next to FIG. 12, a bottom perspective view shows the riser buoy 234 captured within the bay 232 with riser bend restrictors 238 exposed. Compensation arms 242 support the mooring buoys 244 within the cavities 246. Referring to FIGS. 13 and 14, the riser tower 236 extends upward from the riser buoy 234 and terminates in the riser hang-off mechanism 240. Disposed adjacent the riser tower 236 atop the riser buoy 234 are hull fastening points or locks 248 that are part of a central hull locking system. Though two mooring buoys 244 are shown, alternative embodiments may include more than two mooring buoys 244, or a mooring buoy that is part of the riser buoy 234.

Figure 15:
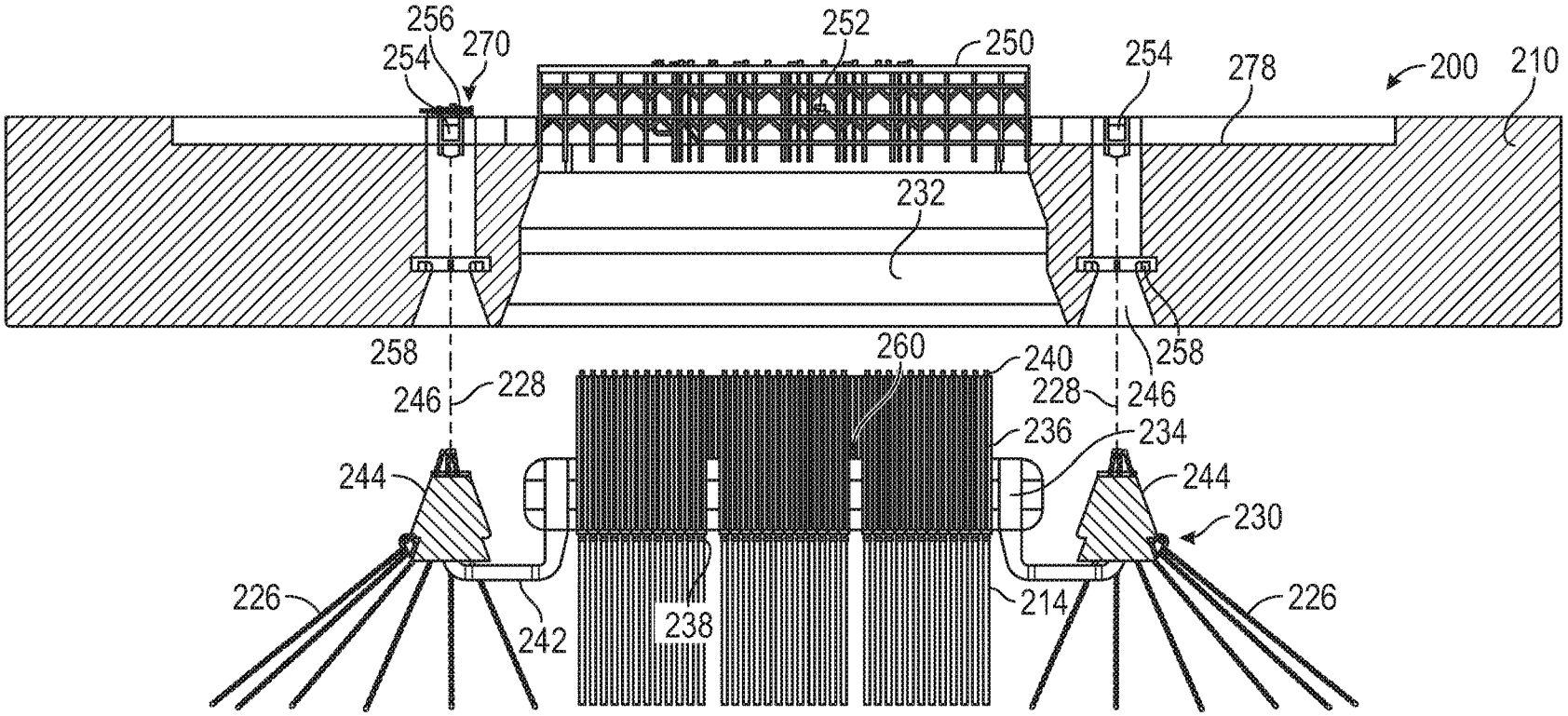
FIG. 15 is a cross-section view of the FPSO and spread moored buoy assembly system of FIG. 11 with the spread moored buoy assembly in a pre-installed, lowered position below the FPSO as schematically shown in FIG. 7.

Referring to FIG. 15, the spread moored buoy assembly 230 is in a pre-installed, lower or submerged position secured below the sea surface and the FPSO bay 232 by the mooring lines 226 coupled to the mooring buoys 244. The mooring buoys 244 are supported by the compensation arms 242 and the riser buoy 234. The risers 214 are coupled to the riser bend restrictors 238 which are in turn coupled to the riser tower 236 in the riser buoy 234, terminating in the riser hang-off mechanism 240. Thus, the risers 214 are received by and coupled to the riser buoy 234. Riser sections 260 are disposed in the riser tower 236. In some embodiments, the riser sections 260 cause the risers 214 to be less stiff thereby allowing FPSO hull deformation with limited transfer of loads into the riser buoy 234. The topside manifold system 250 of the FPSO 210 includes a sheave trolley 252. The lift or pull-in system 270 includes pull or lift winches 254 and a spooling device 256. The winches 254 are disposed over the mooring buoy hull cavities 246 such that they can act on the ropes 228 that are coupled to the mooring buoys 244. The ropes 228 can be stored on winch drums for extension or retraction as needed. Disposed in the mooring buoy hull cavities 246 are locking jacks 258.

Figure 16:
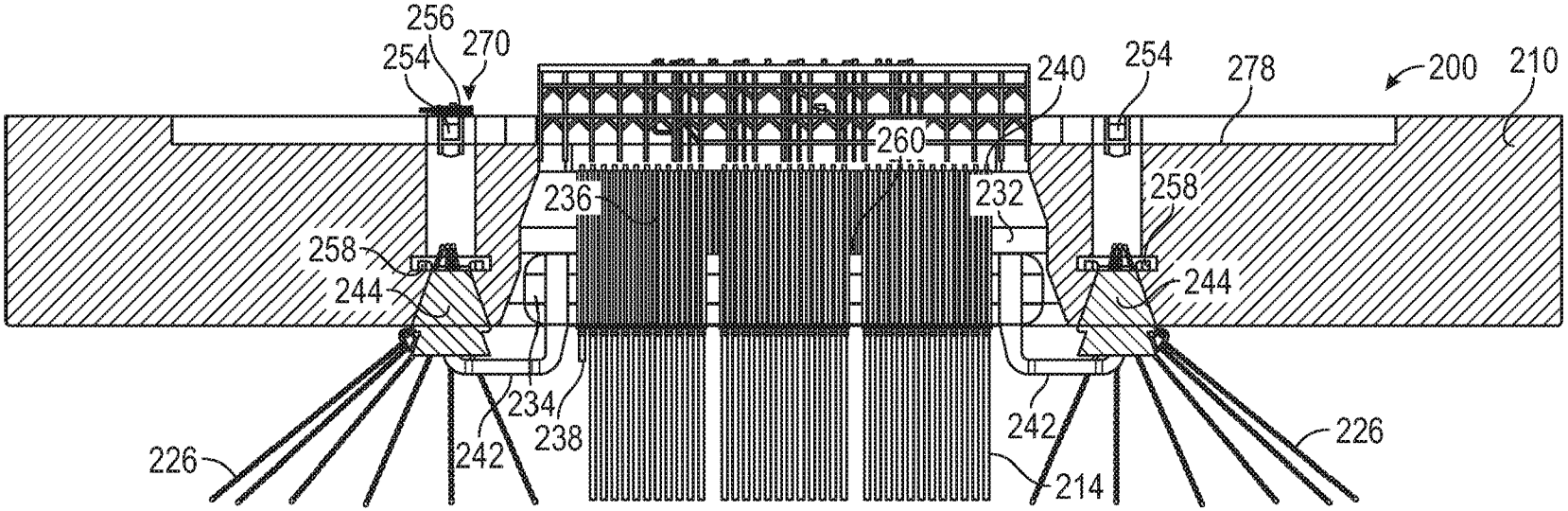
FIG. 16 is a cross-section view of the FPSO and spread moored buoy assembly system of FIG. 15 with the spread moored buoy assembly in a lifted or pulled-in and secured position in an internal position in the FPSO as schematically shown in FIG. 8.

Referring to FIG. 16, the spread moored buoy assembly 230 is in a lifted or pulled-in position wherein the spread moored buoy assembly 230 is lifted into and secured in the FPSO bay 232. As will be described more fully below, the lift winches 254 are actuated to pull on the ropes 228 and thereby lift the mooring buoys 244 along with the remainder of the spread moored buoy assembly 230 toward the FPSO 210. A locking system including hull fastening points 248 and locking jacks 258 is used to secure the spread moored buoy assembly 230 in the FPSO bay 232 and the mooring buoy hull cavities 246 of the FPSO 210.

Figure 17:
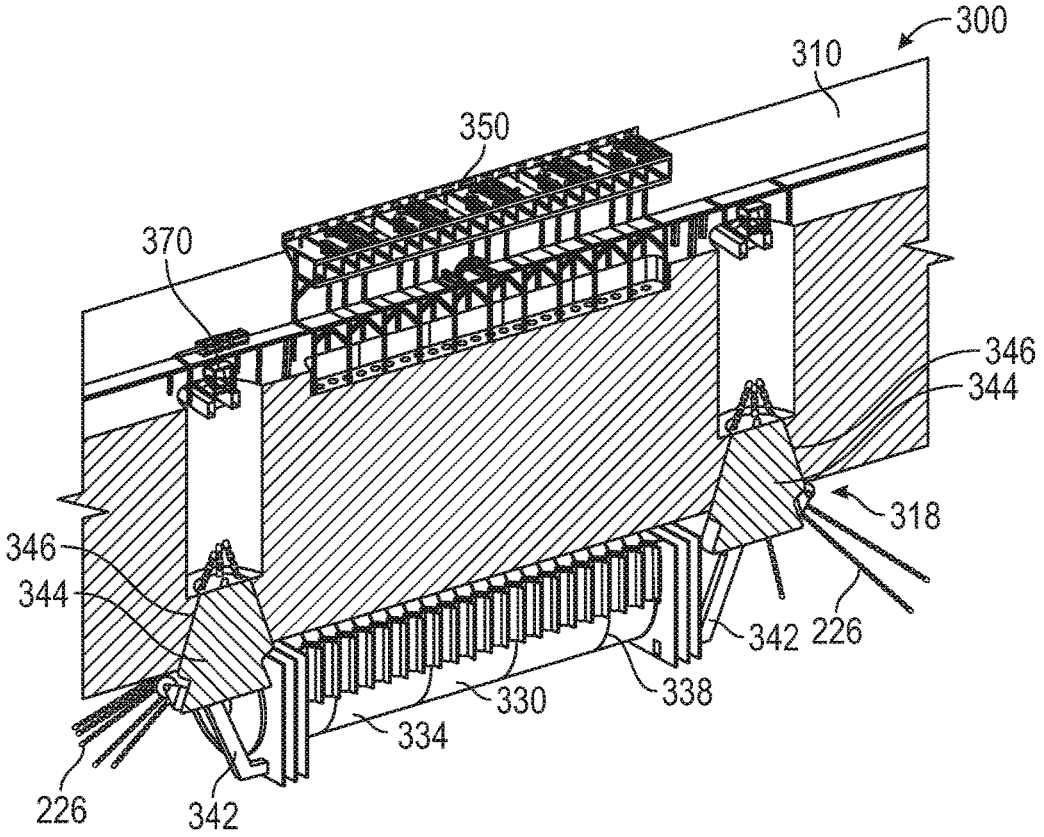
FIG. 17 is a cross-section view of an alternative embodiment of a FPSO and spread moored buoy assembly system with an external spread moored buoy assembly.
Figure 18:
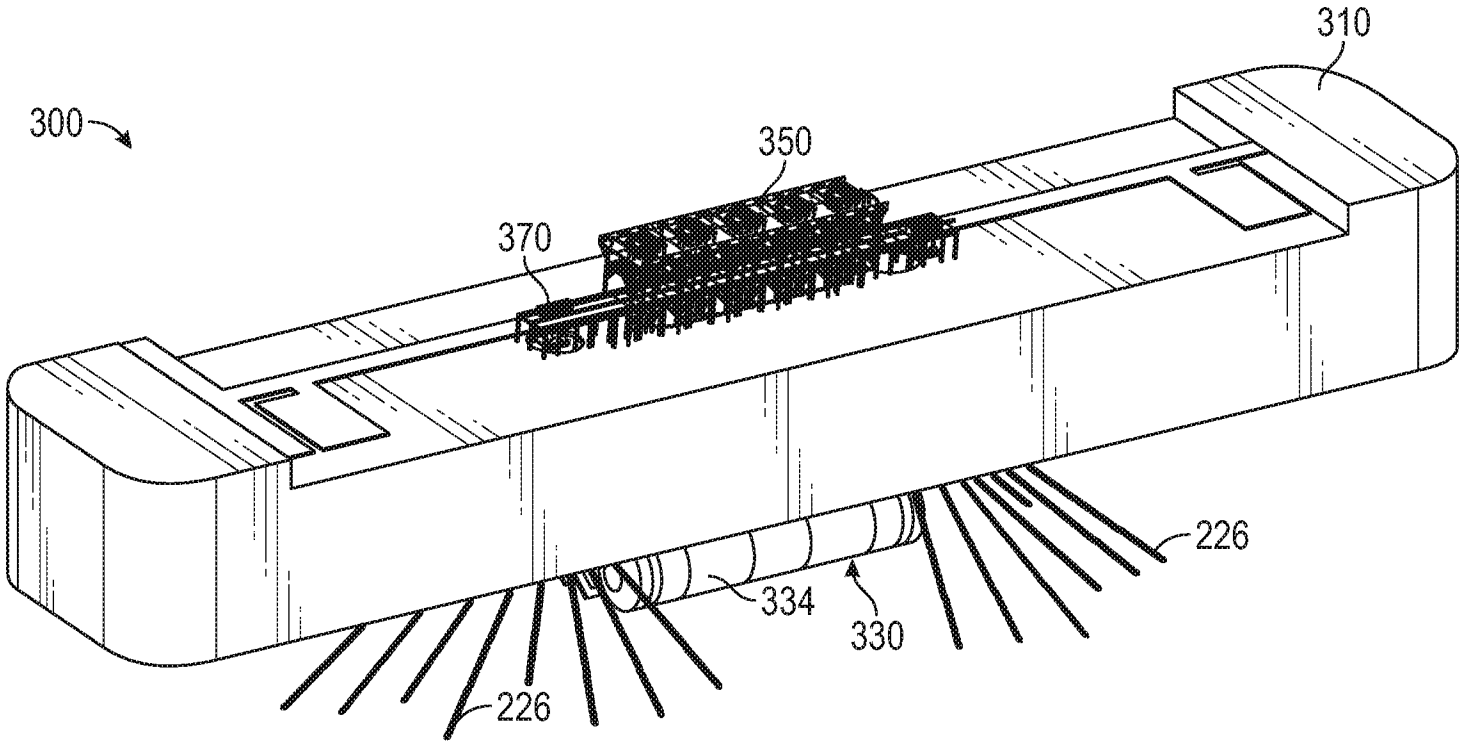
FIG. 18 is a top perspective view of the FPSO and spread moored buoy assembly system of FIG. 17.

The spread moored buoy assembly 230 may also be referred to as an internal or hull internally mounted spread moored buoy assembly because it is secured in the bay 232 that is internal to the FPSO 210. Referring now to FIGS. 17 and 18, in some embodiments the spread moored buoy assembly is external or hull externally mounted, as illustrated by a storage system 300 including a spread moored buoy assembly 330 coupled to a FPSO 310 by a riser buoyancy and hang-off system 318. The assembly 330 may also be referred to as an amidship and center line mounted spread moored riser buoy. The riser buoyancy and hang-off system 318 includes a topside manifold system 350, a lift or pull-in system 370, and the spread moored buoy assembly 330. The spread moored buoy assembly 330 includes a riser buoy housing or hull 334, riser bend restrictors 338, mooring buoy support or compensation arms 342, and mooring buoys 344. The mooring lines 226 couple to the mooring buoys 344 as previously described. The FPSO 310 includes mooring buoy hull cavities 346 to receive the mooring buoys 344.

Figure 19:
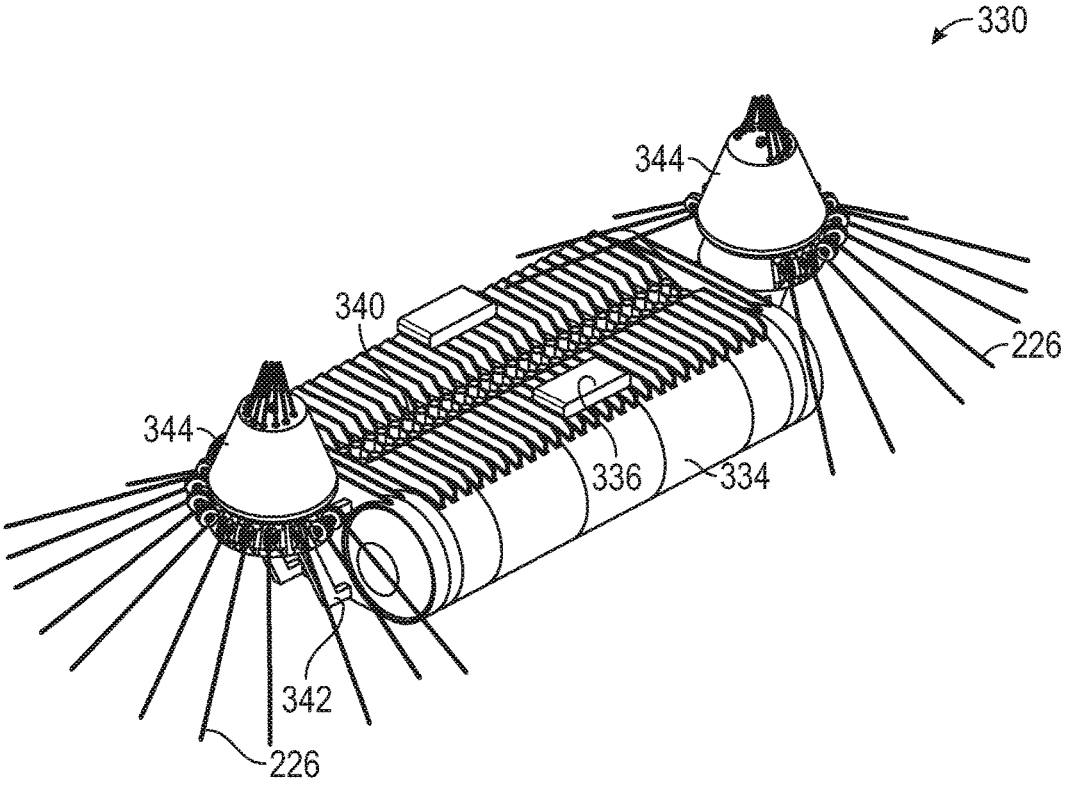
FIGS. 19 and 20 are schematic perspective views of the external spread moored buoy assembly of FIGS. 17 and 18 isolated from the FPSO.
Figure 20:
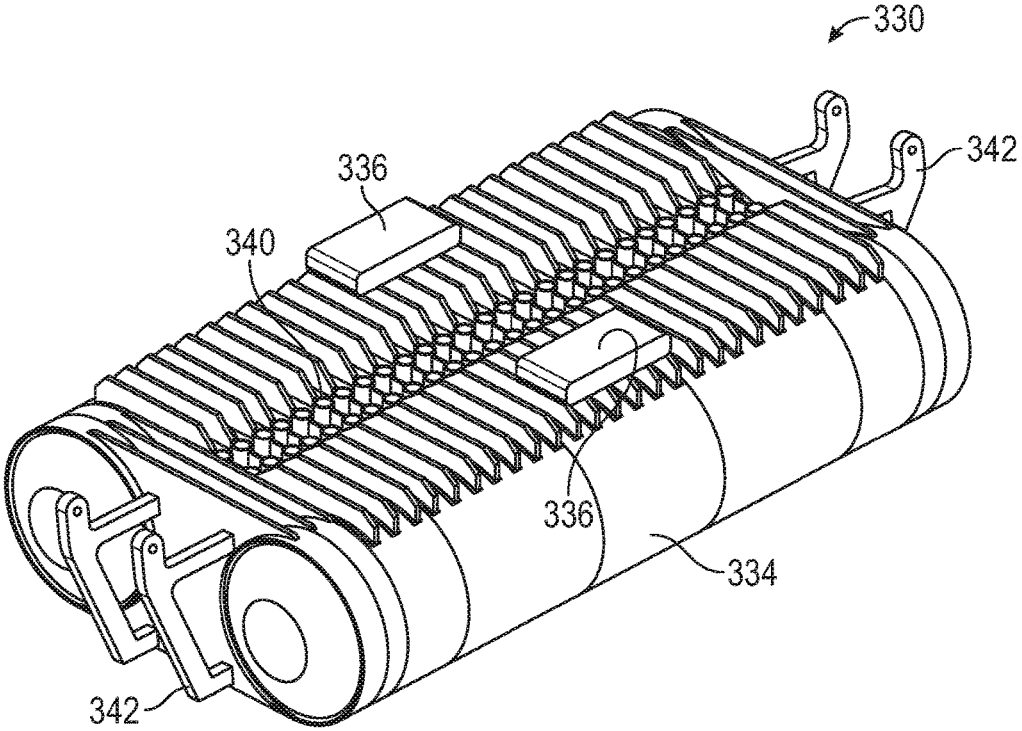

Referring to FIGS. 19 and 20, the spread moored buoy assembly 330 is shown isolated from the FPSO 310. The mooring buoy support arms 342 extend from the riser buoy 334. The riser buoy 334 is kept in place and supported by the mooring buoys 344 through the mooring buoy support arms 342. Disposed atop the riser buoy hull 334 are riser connectors or hang-off mechanism 340 and bumpers 336. The hang-off mechanism 340 is for vertical hang-off and support of risers and control lines. The bumpers 336 function to avoid sideways rotation of the riser buoy 334. After mating the spread moored buoy assembly 330 at the FPSO 310 hull, the risers need to be lifted into and hung off in the FPSO 310 hull. Loads will then be removed from the riser buoy 334, giving the riser buoy 334 positive buoyancy that pre-loads the bumpers 336 into defined locations underneath the FPSO 310 hull. Fine tuning of the preloading can be adjusted by ballasting or deballasting the riser buoy 334.

Figure 21:
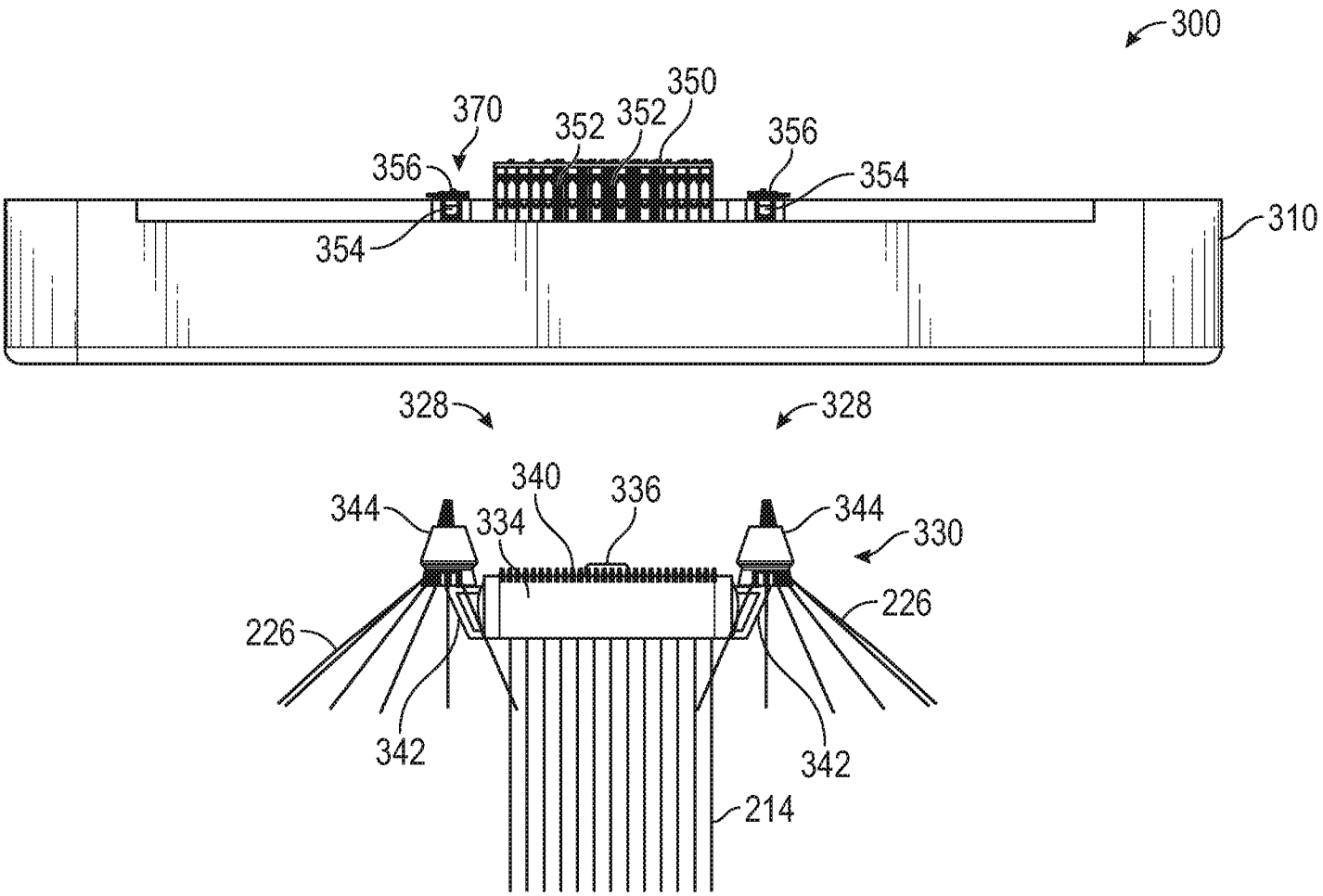
FIG. 21 is a cross-section view of the FPSO and spread moored buoy assembly system of FIG. 17 with the spread moored buoy assembly in a pre-installed, lowered position below the FPSO.

Referring to FIG. 21, the spread moored buoy assembly 330 is in a pre-installed, lower or submerged position secured below the sea surface until the FPSO 310 arrives. As shown, the FPSO 310 has arrived and the spread moored buoy assembly 330 is submerged by the mooring lines 226 coupled to the mooring buoys 344. The mooring buoys 344 are coupled to the arms 342 which are coupled to the riser buoy 334, such that the mooring buoys 344 and the arms 342 support the riser buoy 334. The risers 214 are coupled to the riser bend restrictors 338 (FIG. 17) which are in turn coupled to the riser hang-off mechanism 340. The topside manifold system 350 of the FPSO 310 includes sheave trolleys 352. The lift or pull-in system 370 includes pull or lift winches 354 and spooling devices 256. The winches 354 are disposed over the mooring buoy hull cavities 346 such that they can act on ropes 328 that are coupled to the mooring buoys 344.

Figure 22:
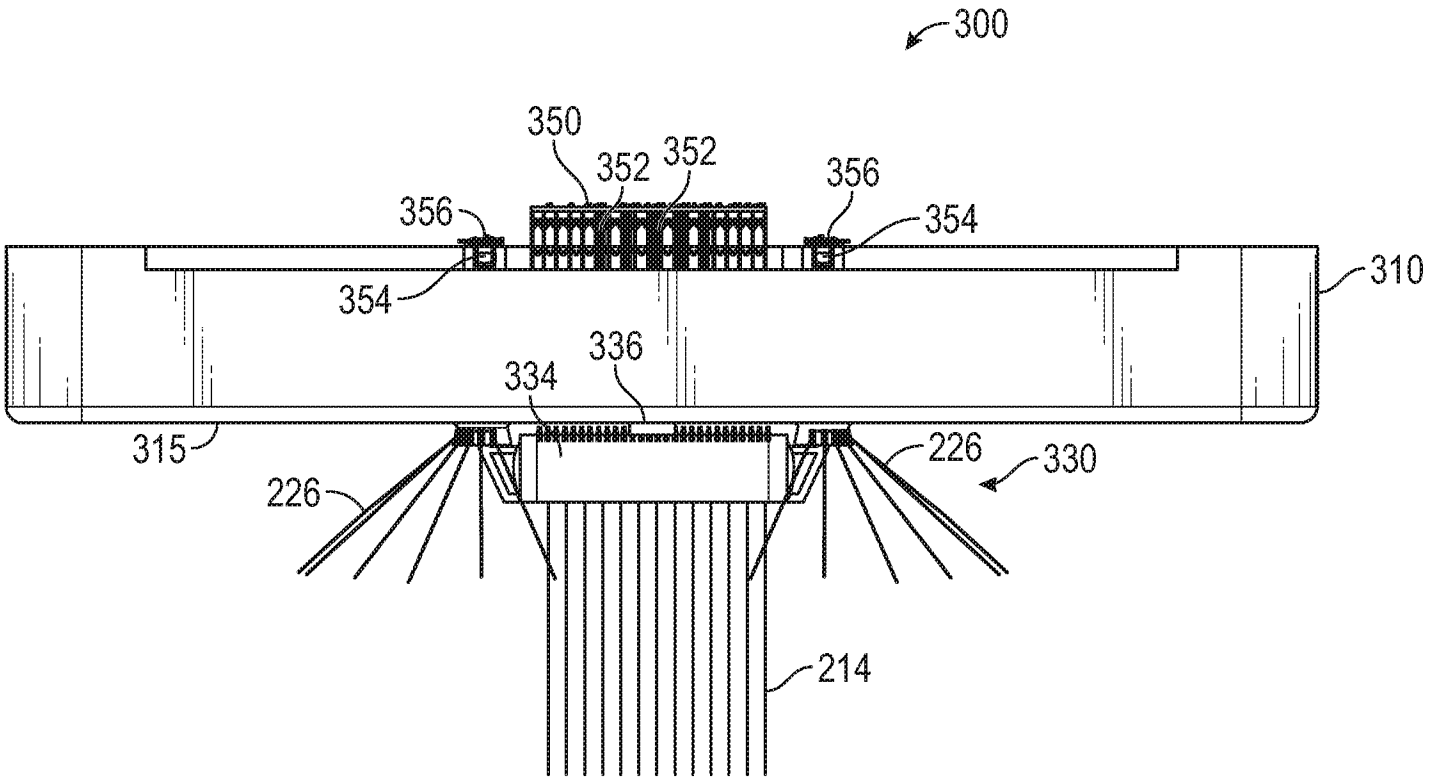
FIG. 22 is a cross-section view of the FPSO and spread moored buoy assembly system of FIG. 21 with the spread moored buoy assembly in a lifted or pulled-in and secured position in an external position adjacent the FPSO.

Referring to FIG. 22, the spread moored buoy assembly 330 is in a lifted or pulled-in position wherein the spread moored buoy assembly 330 is lifted into a position adjacent an underside 315 of the FPSO 310. As will be described more fully below, the lift winches 354 are actuated to pull on the ropes 328 and thereby lift the mooring buoys 344 along with the remainder of the spread moored buoy assembly 330 toward the FPSO 310. A locking system similar to that previously described is used to secure the spread moored buoy assembly 330 at the underside 315 of the FPSO 310 through the mooring buoys 344. Fluidic connections are established between the FPSO 310 and the riser hang-off mechanism 340 while the bumpers 336 provide a contact buffer or guard between the riser buoy hull 334 and the underside 315 of the FPSO 310. In some embodiments, the risers 214 are lifted by the pull-in winches 354 and a pull-in tool through caissons in the FPSO 310 hull and hung off. Upon hang off of the risers 214, fluid connections can be made up.

Figure 23:
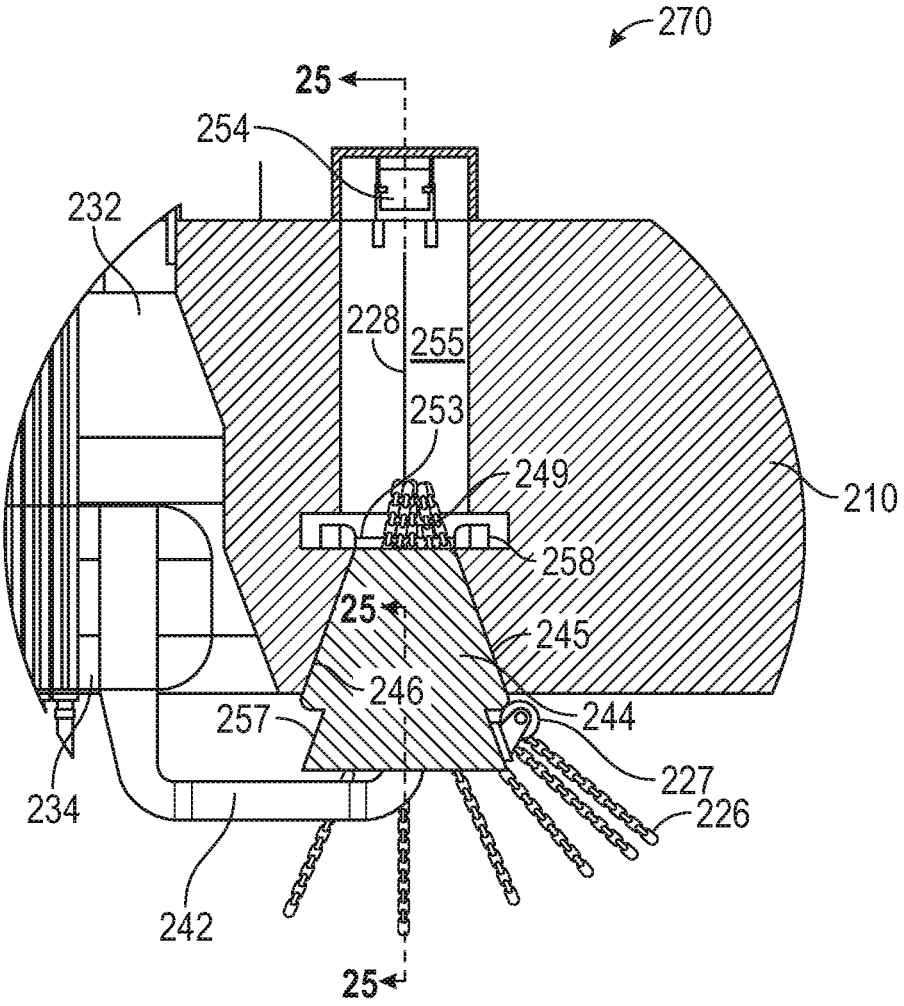
FIG. 23 is an enlarged view of a portion of FIG. 16 showing a detailed illustration of the mooring buoy interface in the hull of the FPSO along with the topside manifold system and the pull-in system.

Referring next to FIG. 23, an enlarged cross-section view of the noted portion of FIG. 16 is shown with the riser buoy 234 and the mooring buoy 244 lifted and secured in the bay 232 and the mooring buoy hull cavity 246, respectively. The lift winch 254 of the lift system 270 is coupled to the rope 228 which extends through a passage or channel 255 and is coupled to a coupling and lifting point 249 on the mooring buoy 244. The mooring buoy 244 also includes a locking extension 253 having a locking groove for receiving the locking jacks 258 and retaining a top portion of the mooring buoy 244 in the mooring buoy hull cavity 246. At a bottom portion of the mooring buoy 244 chain fairleads 227 are mounted in a recess 257 for moveably receiving the mooring lines 226 and thereby securing the bottom portion of the mooring buoy 244. When the mooring buoy 244 is located and secured in the mooring buoy hull cavity 246, a tapered or generally cone-shaped outer surface of the mooring buoy 244 generally mirrors or mates with the tapered or generally cone-shaped inner surface of the mooring buoy hull cavity 246.

Figure 24:
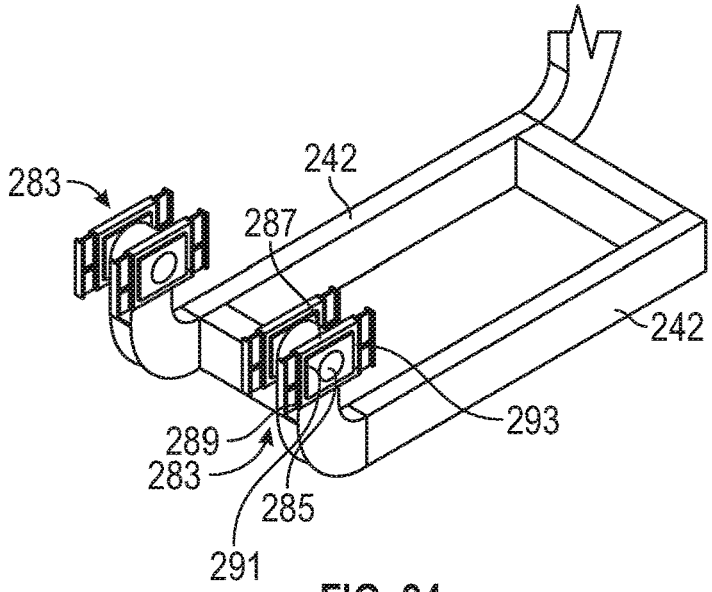
FIG. 24 is a perspective view of a compensation arm of FIG. 23 showing a connection interface between the mooring buoy and the compensation arm with the mooring buoy, chain fairleads, and mooring lines removed.

Referring now to FIG. 24, a perspective view of the compensation arm 242 is shown with the mooring buoy 244, the chain fairleads 227, and the mooring lines 226 removed for clarity. A connection interface 283 is disposed at the end of the compensation arm 242 for coupling to the mooring buoy 244. The connection interface 283 includes a mooring buoy mounting bolt 285, a mooring buoy upper guide 287, a mooring buoy lower guide 289, a guide bracket 291, and a lateral bumper or spring 293.

Figure 25:
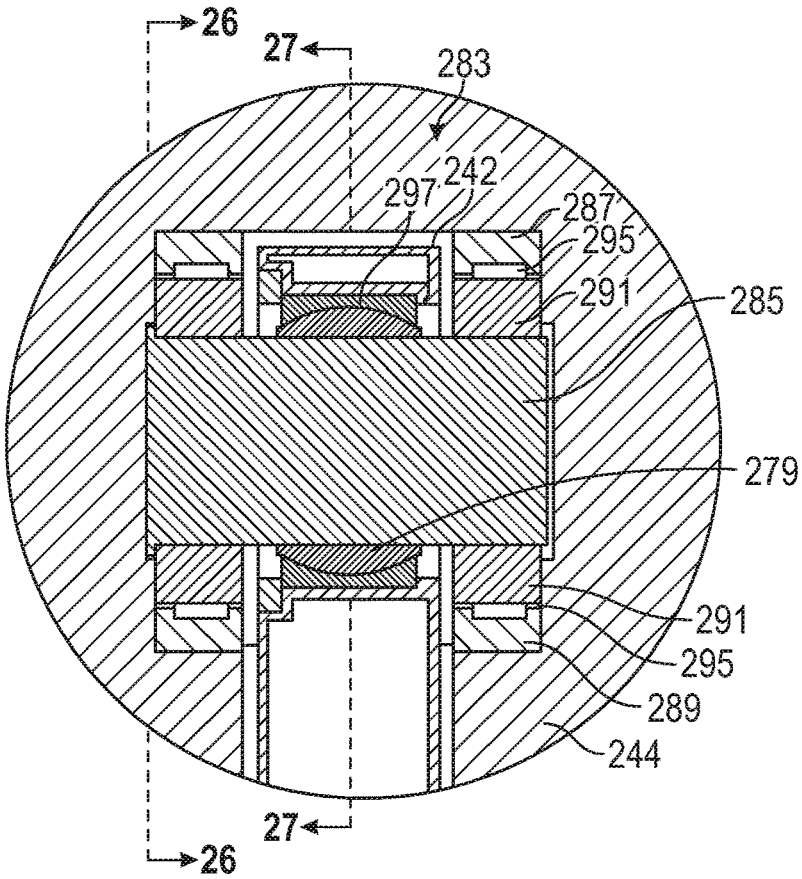
FIG. 25 is an enlarged view of the connection interface shown in cross-section taken at section 25-25 of FIG. 23.

Referring next to FIG. 25, an enlarged view of the connection interface 283 is shown in cross-section within the mooring buoy 244 and taken at section 25-25 of FIG. 23. A centralizing spacer 279 is disposed adjacent the mooring buoy mounting bolt 285. Also disposed about the mooring buoy mounting bolt 285 is a gelenk bearing 297, with the compensation arm 242 disposed on the opposite side of the gelenk bearing from the mooring buoy mounting bolt 285. Disposed between the mooring buoy upper guide 287 and the guide bracket 291 is a guide bracket glide pad 295. Disposed between the mooring buoy lower guide 289 and the guide bracket 291 is another guide bracket glide pad 295.

Figure 26:
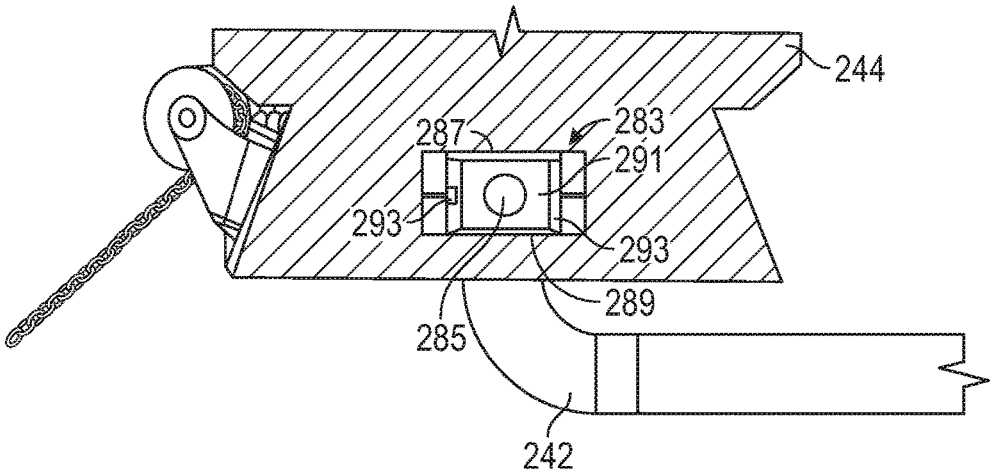
FIG. 26 is another cross-section view of the connection interface within the mooring buoy and taken at section 26-26 of FIG. 25.

Referring to FIG. 26, another cross-section view is shown of the connection interface 283 within the mooring buoy 244 and taken at section 26-26 of FIG. 25. The mooring buoy mounting bolt 285 is shown within the guide bracket 291. The mooring buoy upper guide 287 and the mooring buoy lower guide 289 bound the guide bracket 291 above and below the guide bracket 291, respectively. Lateral bumpers or springs 293 are disposed on the sides of the guide bracket 291.

Figure 27:
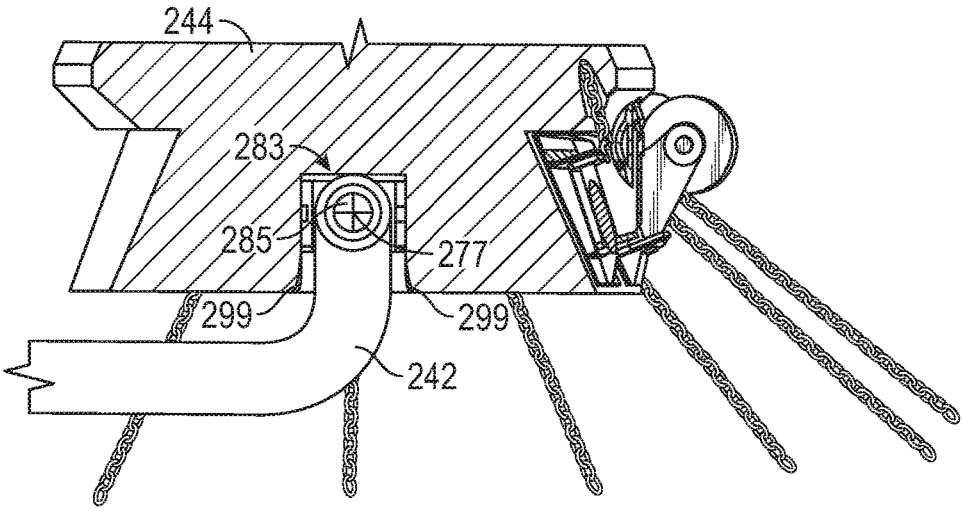
FIG. 27 is a further cross-section view of the connection interface within the mooring buoy and taken at section 27-27 of FIG. 25.

Referring to FIG. 27, a further cross-section view is shown of the connection interface 283 within the mooring buoy 244 and taken at section 27-27 of FIG. 25. The mooring buoy mounting bolt 285 along with the other structures just described with reference to FIGS. 24-26 provide a rotation point 277 for the mooring buoy 244 with respect to the compensation arm 242. Disposed on each side of the compensation arm 242 below the mooring buoy mounting bolt 285 are rotation limiters 299.

Figure 28:
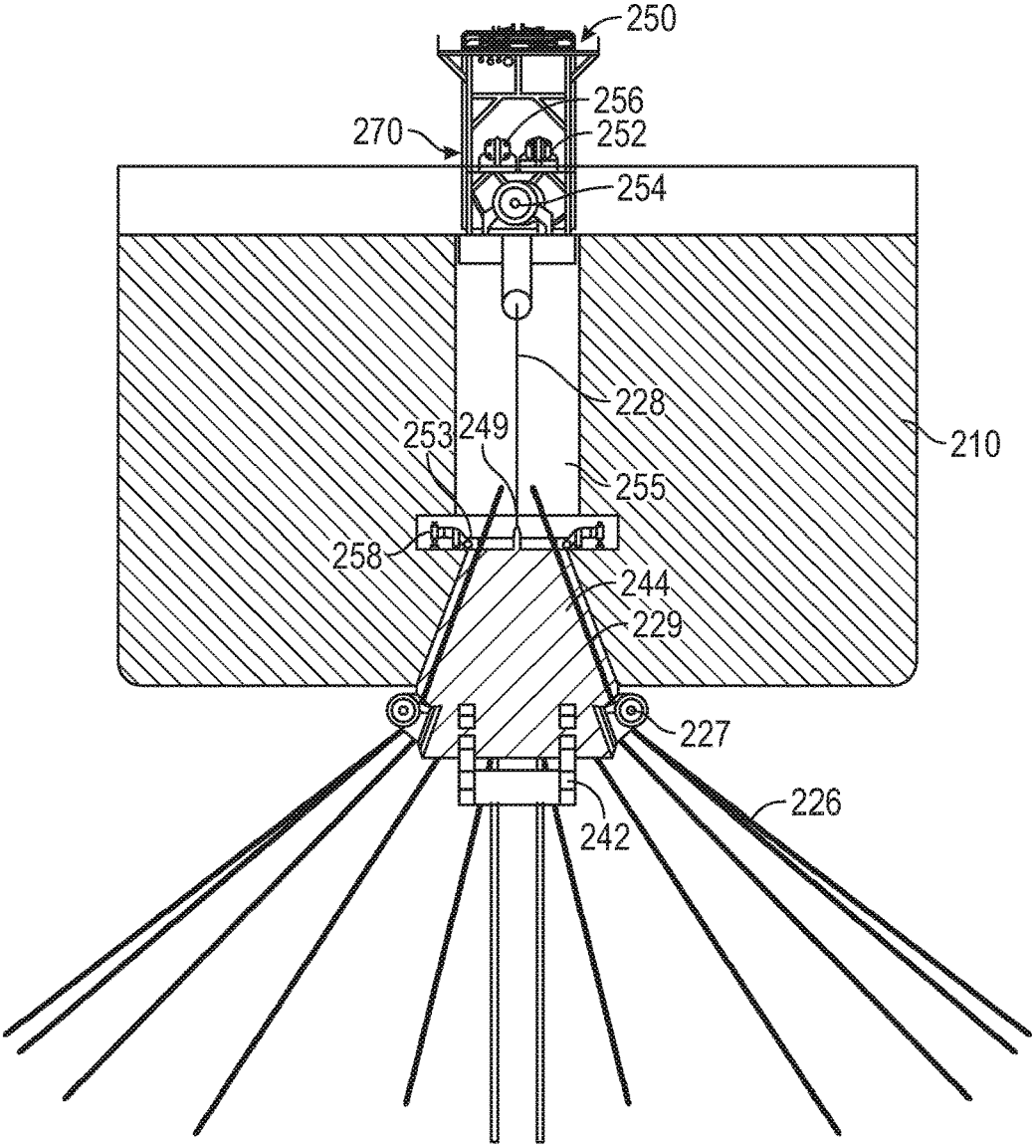
FIG. 28 is a different cross-section view of the mooring buoy interface, the topside manifold system, and the pull-in system of FIG. 23.
Figure 29:
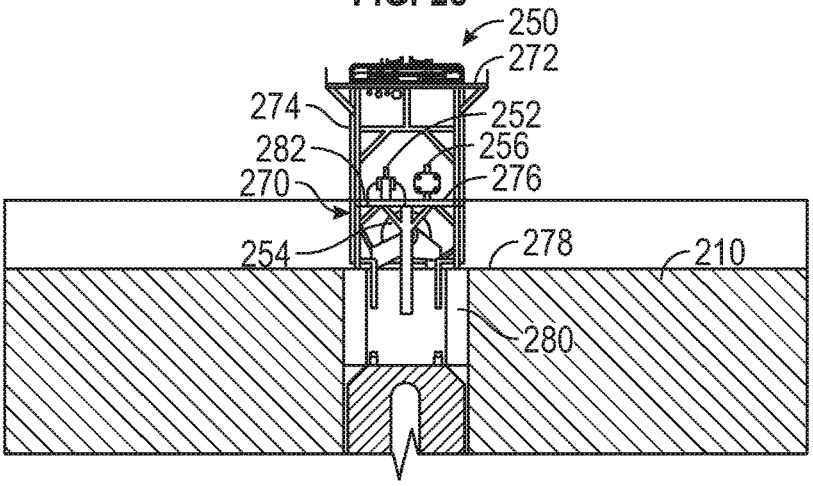
FIG. 29 is an enlarged view of the topside manifold and pull-in systems portion of FIG. 28.

Referring now to FIGS. 28 and 29, a different cross-section view from that of FIG. 23 illustrates further details of the components described with respect to FIGS. 15 and 16. More particularly, the sheave trolley 252, the spooling device 256, and the topside manifold system 250 are shown disposed above the lift winch 254. The lift winch 254 is operably coupled to the rope 228 that extends through the passage 255 to the lift point 249. The locking jacks 258 couple into the locking groove of the locking extension 253. The mooring lines 226 are guided over the chain fairleads 227 and into channels 229 in the mooring buoy 244. The compensation arm 242 is coupled to the mooring buoy 244 so that the mooring buoy 244 can support the riser buoy 234. As shown in FIG. 29, the topside manifold system 250 includes a pig launcher and receiver deck 272, topside piping 274 to be coupled to the risers, a process deck elevation 276 to support the spooling device 256 and the sheave trolley 252, and a skidding rail 282. Just below the lift winch 254 is a main deck elevation 278 and a FPSO recessed deck 280 where risers are presented after the spread moored buoy assembly 230 is lifted into and docked in the FPSO bay 232.

Figure 30:
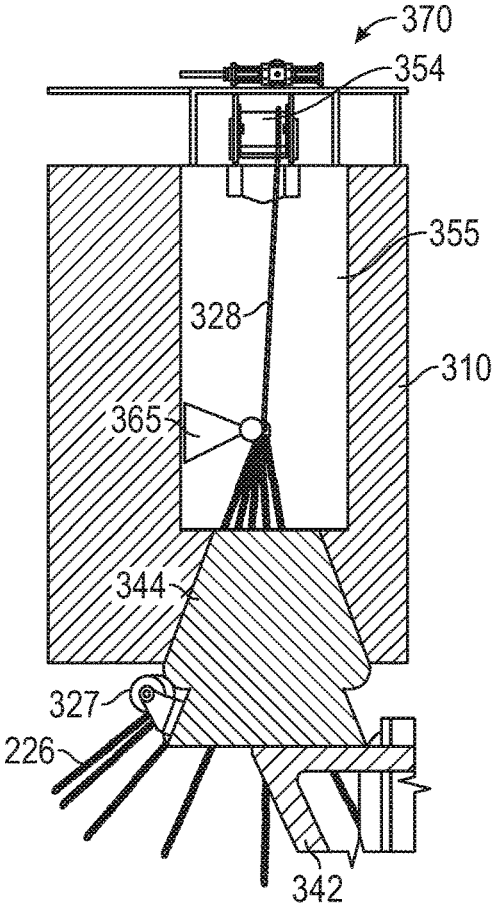
FIG. 30 is an enlarged view of the mooring buoy and pull-in system portion of FIG. 17.
Figure 31:
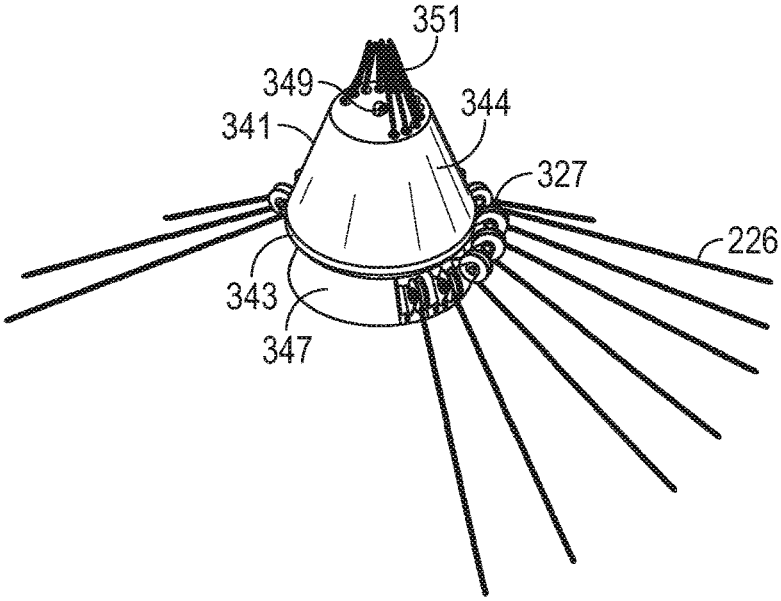
FIG. 31 is a perspective view of the mooring buoy of FIG. 30.
Figure 32:
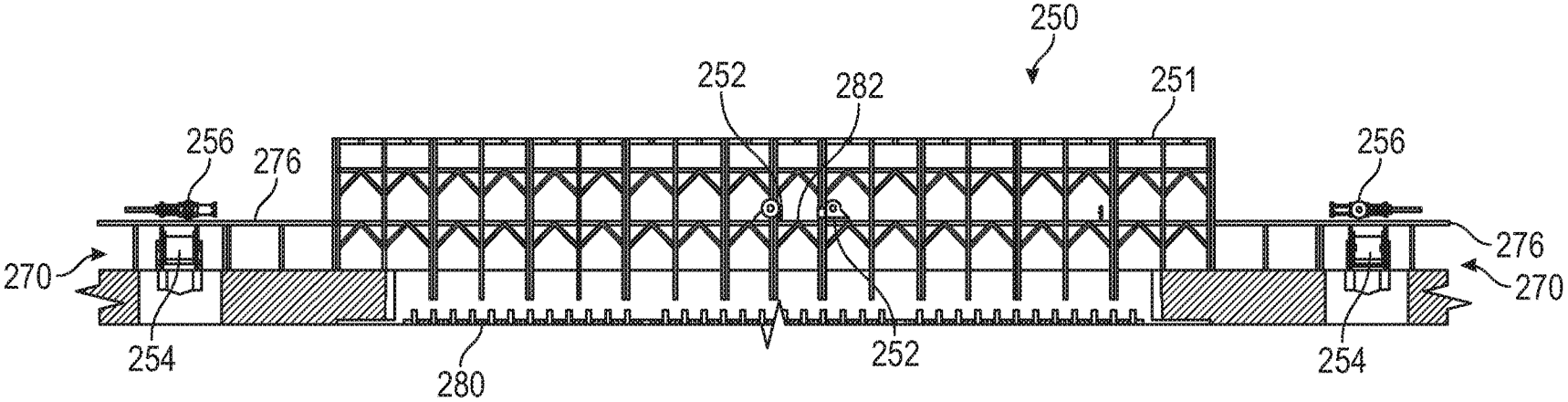
FIG. 32 is a side view of the topside manifold system and pull-in system of FIGS. 15 and 16.
Figure 33:
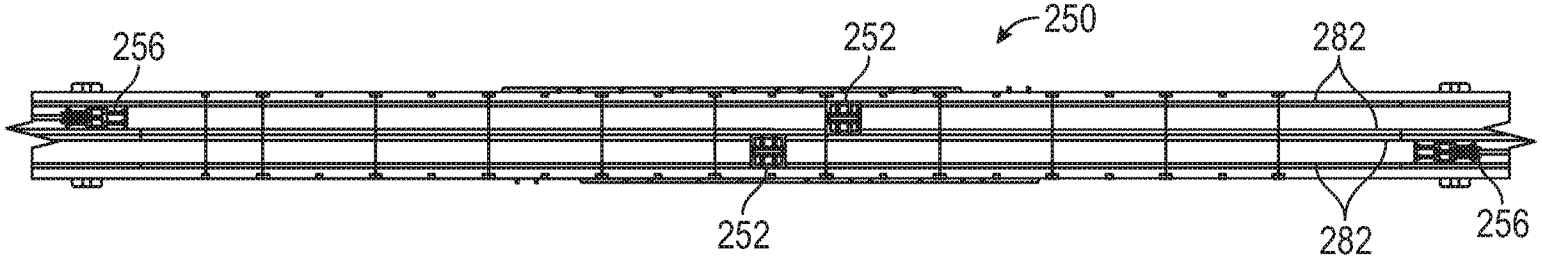
FIG. 33 is a top view of the topside manifold system and pull-in system of FIG. 32.

Referring to FIG. 30, an enlarged view of a portion of FIG. 17 that includes the mooring buoy 344 and the lift system 370 is shown. Many features shown in FIG. 30 are similar to those shown in FIGS. 23-29, with similar reference numerals used. However, a passage 355 includes a guide roller 365 to receive and guide the rope 328 extending between the mooring lines 226 and the lift winch 354. Further, position mooring lines can be pulled in or out for replacement or re-tensioning. Referring to FIG. 31, the mooring buoy 344 includes an upper tapered or cone-shaped portion 341 including a lift point 349, an intermediate ledge or ridge portion 343, and a lower or recessed tapered or cone-shaped portion 347 for supporting chain fairleads 327.

Referring to FIG. 28, a side view of the topside manifold system 250 and the lift system 270 is shown. The sheave trolleys 252 are moveably coupled to the skidding rail 282 inside a framework 251, as is also shown in the top view of FIG. 29. The spooling devices 256 sit atop the process deck elevation 276 and the lift winches 254 are disposed just below. The FPSO recessed deck 280 is disposed for riser presentation. In some embodiments, the lift winches 254 can be re-routed to the sheave trolleys 252 that are moveable on the skidding rail 282 and used for riser 214 pull in or out. In some embodiments, two lift systems 270 serve two individual parallel rows of risers 214. In certain embodiments, the lift systems 270 and lift winches 254 can be re-routed to selectively engage and pull in or out the risers or engage and pull in or out the spread moored buoy assembly.

Figure 35:
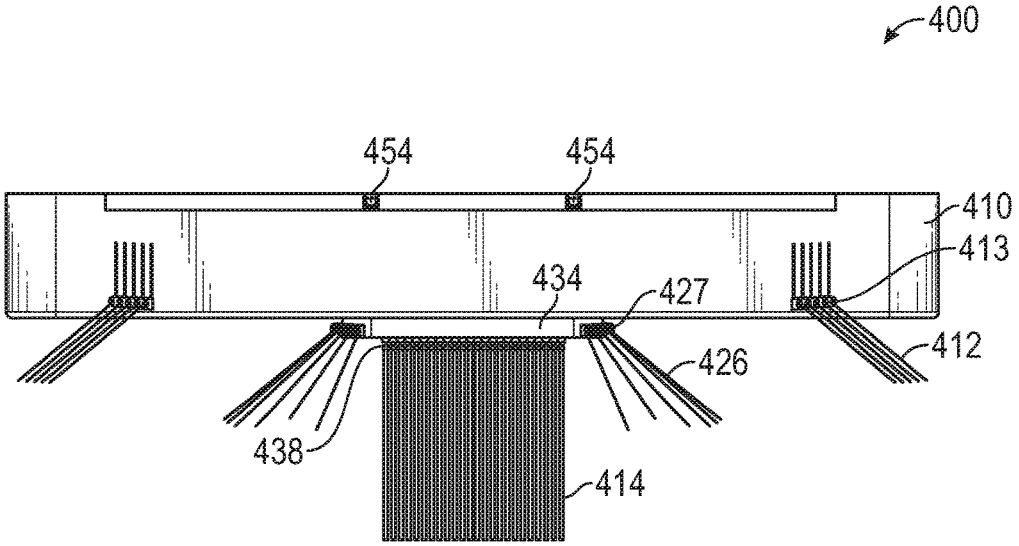

Referring to FIGS. 30 and 31, views of an offshore production and storage system 400 are shown that are similar to those of FIGS. 15 and 16 for system 200. Like components are labeled with like reference numerals and are not discussed in detail here for brevity. However, unlike the spread moored buoy assembly 230, a spread moored buoy assembly 430 does not include mooring buoys 244 and compensation arms 242, or includes separate mooring. Instead, mooring lines 426 and chain fairleads 427 are coupled directly to a riser buoy hull 434, and the system may further include mooring lines 412 coupled to a FPSO 410 (as shown in FIG. 35).

Figure 37:
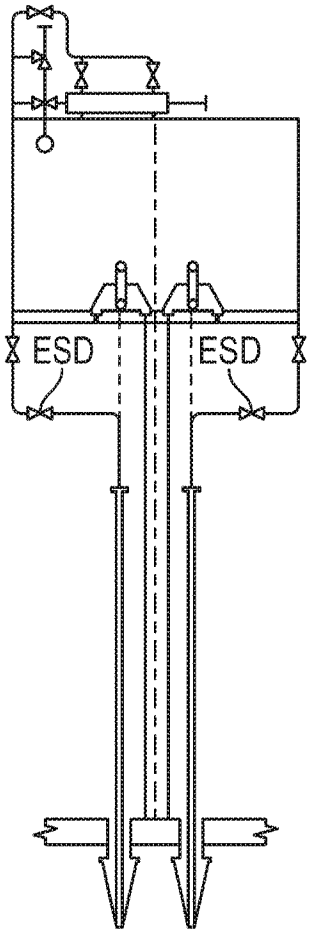
FIG. 37 is a control schematic of the system of FIG. 36.
Figure 36:
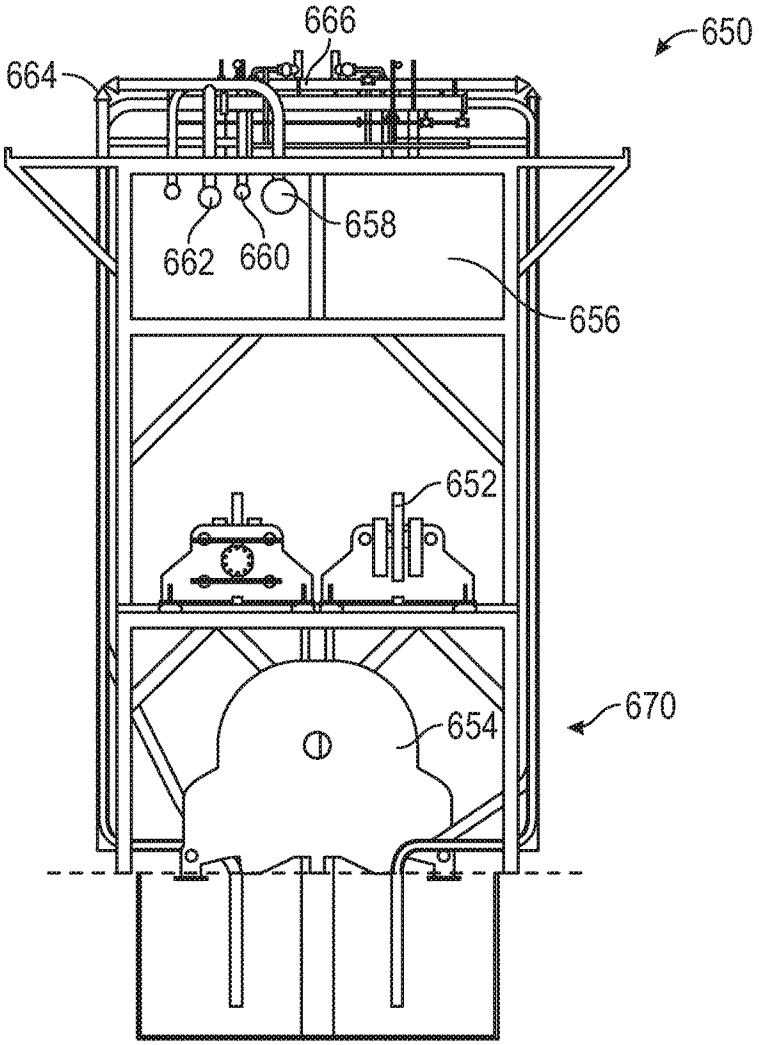
FIG. 36 is an embodiment of a topside manifold and pull-in system in accordance with principles disclosed herein.

Referring to FIG. 36, an embodiment of a topside manifold system 650 and a lift system 670 is shown. The lift system 670 includes a lift winch 654. The topside manifold system 650 includes turn down sheave 652, a production header 658, a service header 660, a test header 662, chokes 664, a pig launcher and receiver 666, and a space 656 for topside piping. Referring to FIG. 37, a schematic is shown illustrating an embodiment of pipe routing and pull-in and pull-out procedures for the risers using the same winches as used for lift or pull-in of the riser buoy assemblies as described above.

Figure 38:
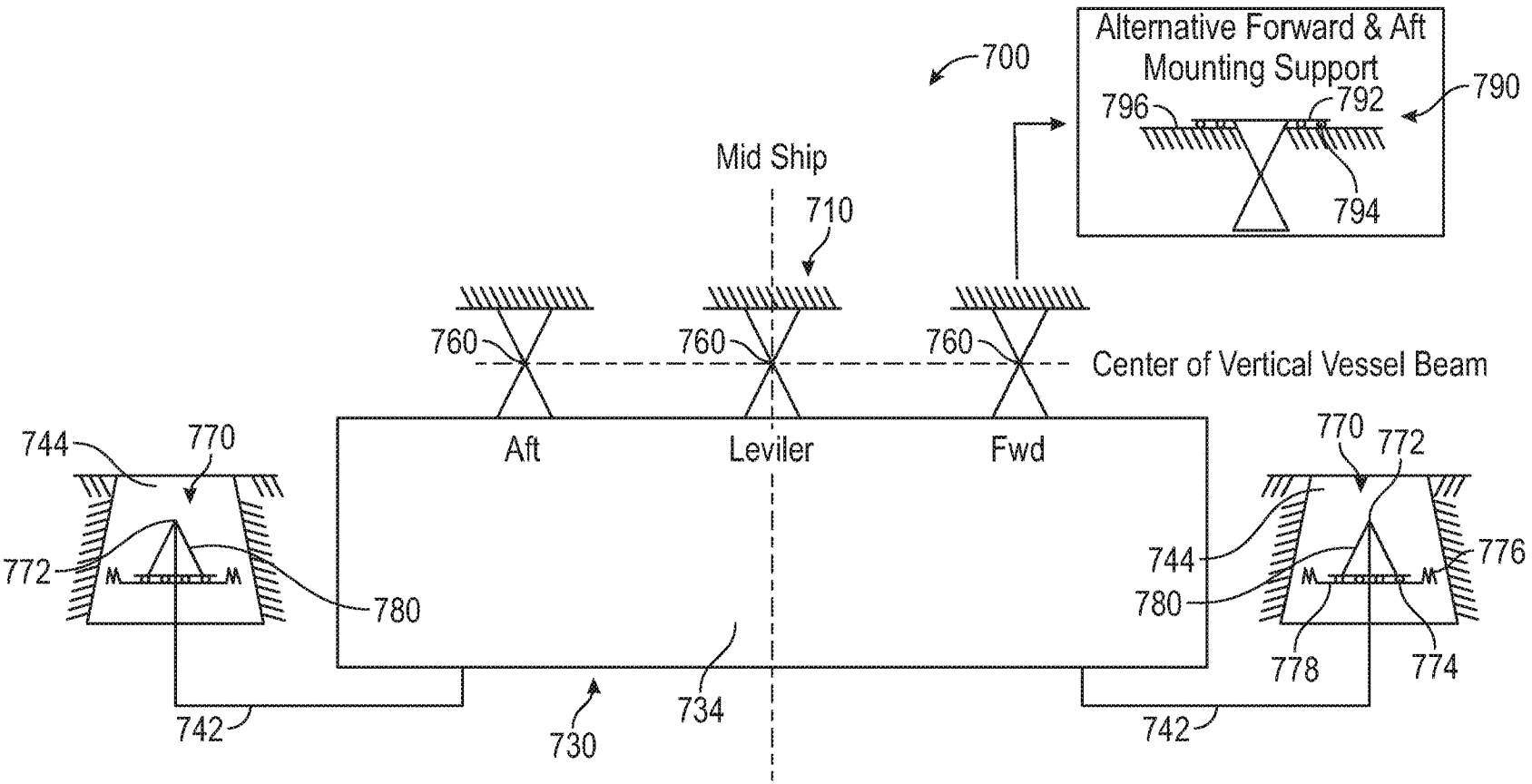
FIG. 38 is an embodiment of a mooring buoy mounting support system.

Referring to FIG. 38, an embodiment of a mounting support system 700 is shown. Mounting support assemblies 760 are coupled between a FPSO 710 and a riser buoy hull 743. In some embodiments, mounting support assemblies 790 include rollers 794 moveably or rotatably coupled between a roller mount 792 and a roller platform 796. In some embodiments, the connection between compensation arms 742, which are coupled to the riser boy hull 734, and mooring buoys 744 includes a moveable mounting support assembly 770. The moveable mounting support assembly 770 includes a hinged connection 772, a roller assembly 780 having rollers 774, a roller platform 778, and force or biasing members 776 operably coupled to the roller platform.

It is understood that certain embodiments as disclosed above can be used regardless of the location of the riser connections into the FPSO.

In operation, and referring to FIGS. 6 through 8, the spread moored buoy (SMB) assembly 230 is pre-installed and pre-commissioned at the site 102 prior to arrival of and docking or connecting to the FPSO 210. Since the SMB assembly 230 has a shorter lead time than the FPSO 210, the SMB assembly 230 is floated out and pre-installed at the site 102. The SMB assembly 230 is submerged below the sea surface 108 with sufficient clearance to the above, later-arriving FPSO 210. The SMB assembly 230 supports all of the risers 214. The SMB assembly 230 includes an adjustable ballast system which provides flexibility to support a variable number of risers 214. In some embodiments, the number of risers 214 will vary because the subsea and riser installation may not be completed until later in the life of the well. The SMB assembly 230 is ballasted or weighted to a steady state below the sea surface 108 to minimize riser and mooring fatigue. The mooring lines 226 couple to the SMB assembly 230 and are used for position mooring of the SMB assembly 230, to keep the SMB assembly 230 and the risers 214 in place before the FPSO 210 arrives. Consequently, in some embodiments, a complete system including the FPSO, the mooring, and the risers are split into two primary assemblies: the SMB assembly 230 and the FPSO. The FPSO 210 is steered to a position at the sea surface 108 above the submerged SMB assembly 230 as shown in FIGS. 7 and 15. It is noted that FIGS. 21 and 34 also show submerged, pre-installed positions of alternative embodiments of the SMB assembly. For ease of description, primary operation will be described with reference to system 200 while many of the same principles apply also to systems 300, 400 except where explicitly noted or where differences are described in detail.

The pull-in winches 254 are located on the main deck 278 above each of the mooring buoy hull cavities 246 to be used to pull in and dock the SMB assembly 230 into the FPSO 210 hull cavity 232. As shown in FIGS. 7 and 15, the pull-in ropes 228 are routed through the mooring buoy hull cavities 246 and coupled to the mooring buoys 244 using pennants. Referring to FIGS. 8 and 16, the pull-in winches 254 are activated to pull or lift on the ropes 228, thus pulling or lifting the mooring buoys 244 and the SMB assembly 230 toward and into the FPSO 210. In this lifted or engaged position of the SMB assembly 230, the riser buoy 234 positioned inside the hull cavity 232 and the mooring buoys 244 are positioned inside the mooring buoy hull cavities 246. The distance traveled by the SMB assembly 230 from the submerged and uninstalled position shown in FIG. 15 to the lifted or engaged position shown in FIG. 16 may be referred to as an installation or docking stroke.

The riser buoy 234 can be fastened into the hull cavity 232 using a plurality of hull fastening points or locks 248. In some embodiments, six or more locks are used. The locks 248 can be located adjacent the middle of the FPSO vessel vertical beam as the deflections and stress at such a location normally are less or minimized. When lifted into the hull cavity 232 the riser buoy 234 will be guided by the central locking system including the locks 248. Toward a latter or end portion of the installation or docking stroke, the central locking system and locks 248 will align the riser buoy 234 and riser connectors 240 with the topside piping 274 (FIG. 29). In some embodiments, the central locking system and locks 248 fix or stabilize the SMB assembly 230 in all directions except rotation around the transverse axle. The forward and aft locks can be free to move in horizontal directions to allow alignment before completing the docking stroke, and can be locked in place when the SMB assembly 230 docking stroke is completed, thereby only allowing rotation around the transverse axis. Alternatively, the forward and aft locks can be allowed translation in the longitudinal direction in addition to rotation around the transverse axle if vessel deflections are large. In some embodiments, the central locking system and locks 248 are adjusted in vertical directions using shims or similar devices. In some embodiments, the risers 214 are connected to the riser head arrangement similar to a conventional riser balcony. In further embodiments, the pull-in winches 254 can be re-routed and used for pulling in or out individual risers at a later time.

In the installed position, the SMB assembly 230 positions the risers 214 generally mid-ship and spread out longitudinally, as shown in FIGS. 3-5, in order to minimize riser motions. Each riser 214 is equipped with the bend restrictor 238 mounted to the underside of the SMB assembly 230 in order to protect each riser 214 from damage due to lateral forces induced by the FPSO vessel's roll and pitch. Thus, the SMB assembly 230 is fixed or installed into the FPSO hull cavity 232 in such a manner that the vessel deflection is not constrained or prohibited by the SMB assembly 230, thereby minimizing stress, weight, and fatigue on the SMB assembly 230. The mooring buoys 244 are located at a distance from each other to ensure proper spread mooring stability of the FPSO 210 when the SMB assembly 230 is installed and fixed in the FPSO 210 hull, and to ensure sufficient spacing for routing of the risers 214.

Due to the FPSO vessel motions and loading conditions, building tolerances, and temperature deviations the SMB assembly 230, in the installed position of FIGS. 8, 9, 11, 12, and 16, is allowed certain freedom of motion relative to the FPSO 210 to avoid hull deflections from the FPSO 210 being transferred to the SMB assembly 230. For example, FIG. 38 illustrates the moveable connection principles between mooring buoys 744, a riser buoy 734, and a FPSO 710 hull. The connection of the riser buoy 734 into the mooring buoys 744 allows a limited rotation around the transverse axis at the hinged connection 772 and a limited translation along the longitudinal axis with moveable mounting support assembly 770 to avoid additional stress in a SMB assembly 730 due to vessel deflection in these directions. The limit of rotation and longitudinal translation between the mooring buoy 744 and the riser buoy 734 is achieved by use of bumper or spring arrangements, also referred to as the force or biasing members 776. Vertical translation between the riser buoy 734 and the mooring buoy 744 is fixed as the riser buoy 734 will need to follow the mooring buoy 744 when lifted into the FPSO hull cavity 232.

The compensation arms 242 connect the riser buoy 234 and the mooring buoys 244 before and after the SMB assembly 230 is installed in the FPSO hull cavity 232. The FPSO 210 will have large displacement due to hogging and sagging when loading and offloading hydrocarbons. The overall displacement of the FPSO 210 hull will create relative displacement between the mooring buoys 244 and the riser buoy 234. The compensation arms 242 and the structural mounting of the compensation arms 242 in the mooring buoys 244 are crucial to avoid high stress in this area. Because of building tolerances and thermal expansion of the FPSO 210 and the SMB assembly 230, flexibility is needed to provide a good fit for the SMB assembly 230 in the FPSO hull cavity 232.

The compensation arm 242 is designed to reduce the vertical loads to be transmitted between the riser buoy 234 and the mooring buoy 244 due to vessel hog and sag deflection. The compensation arm 242 also allows the mooring buoy hull cavity 246 and structural support thereof to be continuous around the mooring buoys 244 to ensure proper load transfer and fit. In some embodiments, the mooring buoys 244 have a fine tolerance fit into the two hull cavities 246 and are preloaded in place with use of the locking jacks 258 in FIG. 23. Such an arrangement will allow the load transfer of the mooring loads to go through a force couple in the upper and lower parts of the mooring buoy cone, such as cone portion 341 in FIG. 31, and into the FPSO hull cavity 232.

In certain embodiments, additional mechanisms can be incorporated and used in the compensation arms 242. Referring to FIGS. 24-27, an alternative mounting mechanism allows for lateral movement tolerance between the riser buoy 234 and the mooring buoy 244 to allow for temperature and building tolerances of the SMB assembly 230 and the FPSO 210. The mechanism also reduces the stress transferred to the SMB assembly 230 from deflection (hogging and sagging) of the FPSO 210, as a limited lateral movement and rotation is allowed. The rotation is limited by the rotation limiter 299 shown in FIG. 27. The connection mechanism is shown in isolation in FIG. 24 where the mooring buoy 244 structure, the chain fairleads 227, and the lines or chains 226 have been removed for clarity. FIG. 25 shows a transverse vertical section view of the connection mechanism. Each compensation arm 242 includes a gelenk bearing 297 and is mounted to the two guide brackets 291 on each side of the compensation arm 242 through the mooring buoy mounting bolt 285. The gelenk bearing 297 ensures better load distribution between the two guide brackets 291. The centralizing spacer 279 ensures the correct alignment of the gelenk bearing 297 and the guide brackets 291. Each guide bracket 291 has four guide bracket glide pads 295, where two of the glide pads 295 run in a crevice in the mooring buoy upper guide 287 and the other two guide pads 295 run in a crevice in the mooring buoy lower guide 289. The glide pads 295 allow for the limited longitudinal translation between the mooring buoy 244 and the riser buoy 234. FIG. 26 shows the same connection mechanism from a side section view. The lateral bumper or spring 293 restricts the longitudinal translation of the mooring buoy 244 and the connection mechanism as they interact with the guide bracket 291 on each side. In certain embodiments, the nominal tolerance is illustrated between the guide bracket 291 and the lateral bumper or spring 293 on each side. FIG. 27 shows a different side section view of the connection mechanism. The rotation limiters 299 are illustrated at each side of the compensation arm 242 to limit the rotation of the mooring buoy 244 around the rotation point 277.

In alternative embodiments, the mounting of the compensation arms can be slightly different. For example, the compensation arms 342 on the externally mounted SMB assembly 330 of FIGS. 17-22 can include a laterally fixed mounting in one of the compensation arm connections to the mooring buoy 344, as a fixation of the riser buoy 334 into the hull. The second or other compensation arm 342 can be arranged and coupled as previously described.

Referring to FIGS. 28-31, details of the mooring buoys 244, 344 are shown. For ease of description, details of both the mooring buoy 244 of FIGS. 28 and 29 and the mooring buoy 344 of FIGS. 30 and 31 will be referenced interchangeably since they share many of the same components. Differences will be noted. The mooring buoy 244 includes the chain fairleads 227, the mooring lines 226, the lifting point 249, the locking extension or groove 253, and the two hinged or rotatable connections 283 (FIG. 24), 772 (FIG. 38) to the riser buoy 234. The mooring buoy 344 has a circular, cone shaped portion 341 to allow proper guiding and fit into the FPSO hull cavity 246. When performing the landing or docking stroke of the SMB assembly 230 into the FPSO 210 hull, the mooring buoy cone 341 will matingly interface with the FPSO hull cavity 246 leaving clearance between the riser buoy 234 and the FPSO hull cavity 246. The locking groove 253 allows fixation of the mooring buoy 244 to the FPSO hull cavity 246 through the locking jacks 258. In some embodiments, both mooring buoys 244 include anti-rotation keys in the top to ensure correct orientation during installation and prevent rotation due to mooring loads relative to the FPSO 210. The chain fairleads 227 is hinged parallel, or close to concentric to the penetrations 229 for the mooring lines 226 going through the mooring buoys 244. The number and size of the mooring lines 226 is governed by the mooring loads on the vessel. The mooring line 226 can be locked after exiting the fairlead 227 in a chain stopper or be suspended in chain flapper locks on top of the mooring buoy 244, 344.

In some embodiments, the mooring lines 226 are installed before the risers 214 are pulled into the SMB assembly 230 with help of a construction vessel or similar. The SMB assembly 230 and the mooring buoys 244 can, in this embodiment, be above the sea surface 108 to allow easy access at vessel light ballast draft. The mooring buoys 244 have lift points 249 on top to allow connection to the pull in/out winches 254. The mooring buoys 244 have approximately negative buoyancy in seawater to ensure good stability of the SMB assembly 230 before the risers 214 and the mooring lines 226 are installed. To ensure the correct buoyancy of the mooring buoys 244, the buoyancy compartments can be filled with a buoyancy material. Other buoyancy compartments may be open to the environment to obtain a variable buoyancy, which increases with decreasing depth, or may contain compressed air cylinders, for example. The top of the mooring buoy 244 hull compartment can be flooded or dry depending on vessel draft.

The riser buoy 234 may also include buoyancy compartments to carry the weight of the SMB assembly 230, the risers 214, and the mooring lines 226. Void spaces or buoyancy material can be used to carry the weight of the SMB assembly 230 without the risers 214 and the mooring lines 226. The buoyancy compartments may be split into several compartments to allow adjustment and stabilization of the SMB assembly 230 to accommodate for the different number and layout of the risers 214 and the mooring lines 226. Adjustment of buoyancy can be accomplished through lines and valves in the top of the riser tower 236 or through separate side mounted WROV panels on the riser tower 236. The buoyancy compartments can be embedded in the FPSO hull when installed to minimize additional drag forces. The buoyancy compartments may be open to the environment to obtain a variable buoyancy, which increases with decreasing depth, or may contain compressed air cylinders, for example.

Referring to FIGS. 13-16, the top of the riser tower 236 is used as a hang off structure for the risers 214 so that the risers 214 can be presented for connection to the topside above the water line. The risers 214 are supported on a vertically adjustable riser hang-off mechanism 240 on top of a caisson stretching through the SMB assembly 230 where the bend restrictors 238 are mounted. The riser tower 236 will be above water when the SMB assembly 230 completes docking into the FPSO 210 hull. The additional weight of the structure and the risers 214 above water is carried by the pull in/out winches 254 in some embodiments, or by increasing the SMB assembly 230 buoyancy in other embodiments. The riser tower 236 is sectioned with riser sections 260 to minimize the stress build up in the structure of the SMB assembly 230 due to the FPSO 210 deflections.

In some embodiments, the buoy locking system 248 is a structural part of the riser tower 236 to support the variable dynamic loads from the risers 214 and vessel deflection, and to minimize the movement of the riser connections relative to the topside. The buoy locking system 248 may also be needed to support the lateral loads from the risers 214. Such lateral loads may also be transferred through the bend restrictors 238 due to vessel roll and pitch and SMB assembly 230 dynamic loads. Alternatively, the SMB assembly 230 can be partly deballasted after installation ensuring that the vertical load in the locking system 248 will be larger than the uplift force created through the lateral forces from the risers 214 and the SMB assembly 230 dynamic loads.

Referring to FIGS. 28, 29, 32, and 33, the process deck 276 may be, for example, located five meters above the main deck 278, and access to process topside is needed from the process deck 276. Above the process deck 276, space is needed for piping and headers between topside modules and riser/umbilical connections. The pig launcher and receiver deck 272 is located at the top deck as a larger width is normally required in this area for pig handling and launcher/receiver systems. Two pull in/out winches 254 on the main deck 278 can be rerouted through a removable spooling device 256 and a sheave trolley 252 on the process deck 276 elevation to able pull in/out individual risers after the SMB assembly 230 docking is completed.

The pull in system can be arranged in two parallel systems to allow pull in of risers in two rows. Two longitudinal rows of the risers 214 can be pulled in utilizing the forward and aft pull in/out winches 254, respectively. The sheave trolleys 252 can be moved along the skidding rail 282 using winches or tractor systems. The sheave trolleys 252 can be mechanically locked into the skidding rails 282 prior to pull in/out. The pull in/out winch 254 can also be rerouted to the mooring buoy hull cavity 246 to allow pull in/out of the mooring lines 226 in single fall. Tensioning of the mooring lines 226 can also be done using the pull in/out winch 254, or in some embodiments, with a separate linear jacking or wildcat system.

After docking of the SMB assembly 230, the risers 214 are presented above water in the FPSO 210 full loaded draft, but below the main deck 278 to minimize the weight lifted out of water and to provide space to ease the topside piping 274, valve placement, and riser lifting arrangement. Hook up of the risers 214 and the topside piping 274 is done with help of the spool piece or similar equipment after the SMB assembly 230 docking is complete. Fine adjustment of the riser 214 elevation before fitting the topside piping spool can be done using the hang-off mechanism 240. The topside piping 274, which is to be coupled with the risers 214, can be routed outside the process deck 276 to allow access in the center and minimize the width requirements of the process deck 276 and allow more space for topside modules.

In some embodiments, a different mounting location of the SMB assembly 230 (or other SMB assemblies as described above) in the FPSO 210 hull would still allow the benefit of pre-installing the SMB assembly 230 at the operation site (field), thus reducing the overall schedule. A different mounting location could be applicable for an FPSO where riser fatigue is not an issue due to, for example, less vessel motions, shorter operational life, or allowing the FPSO to disconnect from field at certain weather conditions.

In some embodiments, a different shape of the SMB assembly 230 could also be beneficial in certain operational scenarios or projects. Referring to FIGS. 21 and 22, the SMB assembly 330 includes riser buoyancy kept below the FPSO 310 after the SMB assembly 330 is docked. Such an arrangement can be beneficial as less cut-out or hull cavity in the FPSO hull is required than in the FPSO 210 as described above, thus improving the structural integrity of the FPSO. The SMB assembly 330 can be pre-installed at operational field as previously described. The riser buoy 334 is shown as submerged pressure vessels. Alternatively, the buoyancy compartments may be open to the environment to obtain a variable buoyancy, which increases with decreasing depth, or may contain compressed air cylinders, for example. The risers 214 are hanged off in the riser buoy 334 as described in earlier embodiments, but will be lifted into the FPSO 310 through caissons and hanged off after the SMB assembly 330 has been docked into the FPSO 310 as seen in FIG. 22. The risers 214 will be lifted up and down using an elevator from the SMB assembly 330 using the pull in/out winches re-routed for riser pull in/out as described in previous embodiments. The risers 214 will, after they are hanged off in the FPSO 310 hull, still be routed through the riser buoy 334 where the bend restrictors will be mounted. The pull in/out of the SMB assembly 330 and the mooring buoys 344 is similar to embodiment described above. The riser buoy 334 can be ballasted or deballasted to achieve a preloading between the FPSO 310 hull and the riser buoy bumper 336 to support the lateral loads from the risers 214 at FPSO 310 roll.

Figure 34:
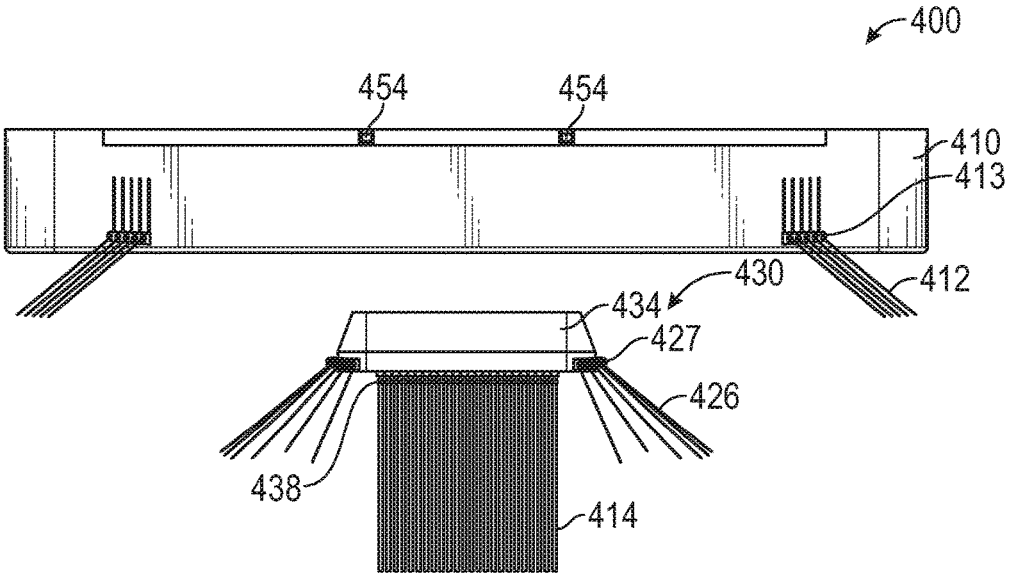
FIGS. 34 and 35 show another embodiment of a FPSO and spread moored buoy assembly system in similar views as for the FPSO and spread moored buoy assembly system of FIGS. 15 and 16.

FIGS. 34 and 35 show an embodiment where a smaller and shorter SMB assembly 430 does not include mooring buoys, such as mooring buoys 244, 344. The SMB assembly 430 can be pre-installed at operational field as previously described. The mooring of a FPSO 410 is a combination between conventional spread mooring 412 and mooring lines 426 from the SMB assembly 430. The mooring lines 412 from the FPSO 410 in addition to the mooring lines 426 from the SMB assembly 430 are needed to avoid large FPSO 410 yaw motions when the longitudinal spacing of the SMB assembly 430 mooring lines 426 are too short. The needed FPSO 410 mooring lines 412 can be transferred from the SMB assembly 430 to the FPSO 410 after docking of the SMB assembly 430. Alternatively, the FPSO mooring lines 412 can be installed in a conventional way with the help of anchor handling and construction vessels.

Risers 414 and mooring are hung off in the SMB assembly 430 prior to docking into the FPSO 410. The docking of the SMB assembly 430 is performed similar to earlier described embodiments utilizing two pull in/out winches. The pull in/out winches will be connected directly in each end of a riser buoy 434. After docking, the risers 414 can be directly coupled to the topside piping 274 or lifted to a higher hang off elevation in the FPSO 410 hull before hook up. Pull in/out of individual risers 414 can be done similar to what is described in earlier embodiments. The riser buoy 434 is locked into the FPSO 410 hull similar to that shown in previous figures.

The SMB assemblies described above also allow for easy disconnect from the FPSO in the event which would require the FPSO to leave the site. In some embodiments, the disconnect procedure is the opposite of the disclosed connection procedures.

In some embodiments, an offshore production and storage system includes a spread moored buoy assembly including a riser buoy coupled to a mooring buoy, the riser buoy configured to receive and couple to risers, wherein the spread moored buoy assembly is configured to be pre-installed offshore with the risers coupled thereto, and wherein the spread moored buoy assembly is configured to couple to a floating vessel such that the risers fluidicly couple to the floating vessel via the riser buoy. The mooring buoy may be configured to couple to the floating vessel apart from the riser buoy coupling and the riser fluidic coupling. The riser buoy may couple into an internal cavity of the floating vessel. The offshore production and storage system may further include two mooring buoys coupled to riser buoy by compensation arms, wherein the riser buoy and the risers couple into an internal cavity of the floating vessel and the mooring buoys couple into mooring buoy hull cavities of the floating vessel. The spread moored buoy assembly is configured to couple to an external and underside surface of the floating vessel.

In some embodiments, an offshore production and storage system includes a spread moored buoy assembly including a riser buoy and two mooring buoys coupled to the riser buoy, risers coupled to the riser buoy, and a floating vessel configured to receive the riser buoy and thereby fluidicly couple to the risers, and configured to receive the mooring buoys separately from the riser buoy and the risers. In some embodiments, an offshore production and storage system includes a spread moored buoy assembly coupled to risers, the spread moored buoy assembly configured to be pre-installed offshore with the risers coupled thereto and a fixed heading floating vessel configured to receive and fix the spread moored buoy assembly to the floating vessel FPSO.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. An offshore production and storage system, comprising:

a spread moored buoy assembly including a riser buoy coupled to a mooring buoy, the riser buoy configured to receive and directly couple to risers;

wherein the spread moored buoy assembly is configured to be pre-installed offshore with the risers coupled thereto; and wherein the spread moored buoy assembly is configured to couple to a floating vessel such that the risers fluidicly couple to the floating vessel via the riser buoy.

2. An offshore production and storage system, comprising:

a spread moored buoy assembly including a riser buoy coupled to a mooring buoy, the riser buoy configured to receive and couple to risers;

wherein the spread moored buoy assembly is configured to be pre-installed offshore with the risers coupled thereto;

wherein the spread moored buoy assembly is configured to couple to a floating vessel such that the risers fluidicly couple to the floating vessel via the riser buoy; and wherein the mooring buoy is configured to couple to the floating vessel apart from the riser buoy coupling and the riser fluidic coupling.

3. The offshore production and storage system of claim 1, wherein the riser buoy couples into an internal cavity of the floating vessel.

4. An offshore production and storage system, comprising:

a spread moored buoy assembly including a riser buoy coupled to a mooring buoy, the riser buoy configured to receive and couple to risers;

wherein the spread moored buoy assembly is configured to be pre-installed offshore with the risers coupled thereto; and wherein the spread moored buoy assembly is configured to couple to a floating vessel such that the risers fluidicly couple to the floating vessel via the riser buoy; and further comprising a compensation arm coupled between the riser buoy and the mooring buoy.

5. The offshore production and storage system of claim 4, wherein the mooring buoy is moveable relative to the compensation arm.

6. The offshore production and storage system of claim 1, further comprising two mooring buoys coupled to the riser buoy by compensation arms, wherein the riser buoy and the risers couple into an internal cavity of the floating vessel and the mooring buoys couple into mooring buoy hull cavities of the floating vessel.

7. The offshore production and storage system of claim 1, wherein the spread moored buoy assembly is configured to couple to an external and underside surface of the floating vessel.

8. The offshore production and storage system of claim 1, further comprising locks to moveably couple the spread moored buoy assembly to the floating vessel.

9. An offshore production and storage system, comprising:

a spread moored buoy assembly including a riser buoy and two mooring buoys coupled to the riser buoy;

risers coupled to the riser buoy; and a floating vessel configured to receive the riser buoy and thereby fluidicly couple to the risers, and configured to receive the mooring buoys separately from the riser buoy and the risers.

10. The offshore production and storage system of claim 9, further comprising moveable compensation arms coupled between each of the mooring buoys and the riser buoy.

11. The offshore production and storage system of claim 9, further comprising an internal hull cavity to receive the riser buoy and the risers, and two mooring buoy hull cavities each to receive one of the two mooring buoys.

12. The offshore production and storage system of claim 9, further comprising locks to moveably couple the riser buoy to the floating vessel.

13. An offshore production and storage system, comprising:

a spread moored buoy assembly coupled to risers, the spread moored buoy assembly configured to be pre-installed offshore with the risers coupled thereto; and a fixed heading floating vessel fixed by mooring lines, the fixed heading floating vessel configured to receive and fluidicly couple to the spread moored buoy assembly while the fixed heading floating vessel is fixed by the mooring lines.

14. The offshore production and storage system of claim 13, wherein an internal bay of the floating vessel is configured to receive a riser buoy of the spread moored buoy assembly and two hull cavities in the floating vessel are configured to receive two mooring buoys of the spread moored buoy assembly.

15. The offshore production and storage system of claim 13, wherein hull cavities in the floating vessel are configured to receive mooring buoys of the spread moored buoy assembly while a riser buoy of the spread moored buoy assembly is configured to be secured at the external and underside surface of the floating vessel.

16. The offshore production and storage system of claim 13, wherein the floating vessel includes an underside opening to receive a submerged riser buoy of the spread moored buoy assembly.

* * * * *